US010812895B2

(12) United States Patent
Croft, III et al.

(10) Patent No.: US 10,812,895 B2
(45) Date of Patent: Oct. 20, 2020

(54) MULTI-DRIVER LOUDSPEAKER WITH CROSS-COUPLED DUAL WAVE-COLUMNS

(71) Applicant: Dolby Laboratories Licensing Corporation, San Francisco, CA (US)

(72) Inventors: James J. Croft, III, Bellevue, WA (US); Michael J. Smithers, Kareela (AU); Garth Norman Showalter, Ozark, MO (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/465,820

(22) PCT Filed: Dec. 14, 2017

(86) PCT No.: PCT/US2017/066473

§ 371 (c)(1),
(2) Date: May 31, 2019

(87) PCT Pub. No.: WO2018/112231

PCT Pub. Date: Jun. 21, 2018

(65) Prior Publication Data

US 2020/0029150 A1 Jan. 23, 2020

Related U.S. Application Data

(60) Provisional application No. 62/433,917, filed on Dec. 14, 2016.

(30) Foreign Application Priority Data

Dec. 14, 2016 (EP) ..... 16204050

(51) Int. Cl.

| | |
|---|---|
| ***H04R 1/00*** | (2006.01) |
| ***H04R 9/06*** | (2006.01) |
| ***H04R 1/28*** | (2006.01) |

(52) U.S. Cl.
CPC ..... *H04R 1/2811* (2013.01); *H04R 1/2819* (2013.01); *H04R 1/2842* (2013.01);
(Continued)

(58) Field of Classification Search
CPC .. H04R 2440/00–07; H04R 9/06; H04R 1/00; H04R 2205/022; H04R 2201/401; H04R 2201/405
(Continued)

(56) References Cited

U.S. PATENT DOCUMENTS

| | | |
|---|---|---|
| 3,022,377 A | 2/1962 | Bobb |
| 3,136,383 A | 6/1964 | Hopkins |

(Continued)

FOREIGN PATENT DOCUMENTS

| | | |
|---|---|---|
| CN | 1283066 | 2/2001 |
| CN | 1408194 | 4/2003 |

(Continued)

OTHER PUBLICATIONS http://caod.oriprobe.com/articles/9144265/Principle_of_Wavefront_Coupling_of_Linear_Sound_Source_Loudspeaker_Arr.htm.

*Primary Examiner* — Suhan Ni

(57) ABSTRACT

A dual wave-column, dual-driver loudspeaker enclosure is described. The two drivers are cross-coupled through their respective front and back sides by two single exit wave-columns. At the ¼ wavelength frequency of the waveguide length, both drivers resonate with the waveguides, and cone motion is minimized while output is maximized. At the ½ wavelength frequency, the front wave of the first driver is in-phase with, the rear wave of the second driver such that the output is increased, reinforced, and smoothed at that frequency. At the ⅓ wavelength frequency, the two wave-column mouth outputs exhibit acoustic mutual coupling,
(Continued)

which boosts acoustic output and reduces cone motion at the critical maximum displacement frequency.

18 Claims, 29 Drawing Sheets

(52) U.S. Cl.
CPC ..... *H04R 1/2857* (2013.01); *H04R 1/2896* (2013.01); *H04R 2201/029* (2013.01)

(58) Field of Classification Search
USPC ..... 381/152, 335, 182
See application file for complete search history.

(56) References Cited

U.S. PATENT DOCUMENTS

| | | | | |
|---|---|---|---|---|
| 3,608,665 | A | 9/1971 | Drisi | |
| 4,875,546 | A | 10/1989 | Krnan | |
| 5,109,416 | A | 4/1992 | Croft | |
| 5,590,208 | A | 12/1996 | Koyano | |
| 6,389,146 | B1 | 5/2002 | Croft, III | |
| 6,411,721 | B1 | 6/2002 | Spindler | |
| 7,184,098 | B2 * | 2/2007 | Pencil | G09G 3/20 348/615 |
| 7,392,880 | B2 | 7/2008 | Buck | |
| 8,014,545 | B2 * | 9/2011 | Grant | H04R 1/025 181/150 |
| 2006/0029241 | A1 | 2/2006 | Graber | |
| 2009/0003639 | A1 | 1/2009 | Aylward | |
| 2012/0008813 | A1 | 1/2012 | Rosen | |
| 2014/0314249 | A1 | 10/2014 | Fincham | |
| 2014/0341394 | A1 | 11/2014 | Croft, III | |

FOREIGN PATENT DOCUMENTS

| | | |
|---|---|---|
| CN | 1665346 | 9/2005 |
| CN | 101933341 | 12/2010 |
| CN | 102131137 | 7/2011 |
| CN | 201904889 | 7/2011 |
| CN | 203734819 | 7/2014 |
| JP | 04329798 | 11/1992 |
| JP | 2001016673 | 1/2001 |
| JP | 2002330486 | 11/2002 |
| WO | 2006020429 | 2/2006 |

* cited by examiner

MULTI-DRIVER LOUDSPEAKER WITH CROSS-COUPLED DUAL WAVE-COLUMNS

FIELD OF THE INVENTION

One or more implementations relate generally to audio loudspeakers, and more specifically to loudspeakers having a multi-driver arrangement creating an interactive, cross-coupled wave-column system.

BACKGROUND

Passive loudspeaker design requires a compromise among the principal characteristics of enclosure volume, efficiency, and low-frequency bandwidth. The ideal speaker is typically one that is small and efficient, with good bass response; however, the well-known Hoffman's Iron Law, dictates that if one improves one or two of these three characteristics, in a practical loudspeaker the remaining characteristic(s) generally suffer. Thus, speakers with good bass are usually quite large, while small speakers may be inefficient and/or have weak bass response.

Certain techniques have been developed to optimize the characteristics of passive loudspeaker enclosures. For example, a few decibels of efficiency gain on the physical limit may be achieved by increasing the high-pass slope rate of the system, and it is possible to increase the effective compliance and size reduction of the enclosure, such as by changing the fluid medium. The ultimate limitation of all these systems, however, is the large signal output capability at low frequencies due to the large excursion requirements of present enclosure architectures.

Bass speakers, such as subwoofers or low-frequency effect (LFE) speakers typically feature acoustic suspension (sealed) enclosures or bass reflex (ported or vented) enclosures. These different enclosure types provide different bass-response characteristics, and basic speaker theory dictates that a bass reflex configuration will provide more extended bass response down to the −3 dB cut-off frequency (known as $F_C$ or $F_3$) than an acoustic suspension system for a given efficiency and enclosure volume. However, the diaphragm displacement required for the same acoustic output is also different for these types of enclosures.

FIG. 1A illustrates the diaphragm displacement versus the frequency of these different enclosure types for equal acoustic output, as presently known. Curve 102 illustrates the diaphragm displacement (in mm) for an acoustic suspension enclosure (e.g., sealed subwoofer), curve 104 illustrates the diaphragm displacement versus frequency (Hz) for a bass reflex enclosure (e.g., ported subwoofer), and curve 106 illustrates the diaphragm displacement for a dual-tuned reflex bandpass enclosure. Acoustic suspension systems deliver all output directly from a single surface of the driver diaphragm and therefore have the greatest excursion requirements for a given acoustic output, as shown by curve 102. Single-tuned bass reflex systems have a single frequency of displacement minimum ($F_{B1}$) and, for a given passband, can provide substantially more output than the acoustic suspension system for a given driver diaphragm area and excursion, as shown by curve 104. Curve 106 represents a multi-tuned bass reflex bandpass enclosure that has been recently proposed. As shown by this curve, each tuning frequency ($F_{B1}$ and $F_{B2}$) creates a frequency of displacement minimum, and a modest gain of efficiency. Unfortunately, between the two tuning frequencies, the dual-tuned bandpass requires even more excursion that the acoustic suspension or simple bass reflex systems.

Additionally, prior art forms of ¼-wave resonant tuned pipes have been hampered with significantly irregular frequency response due to high-Q resonances occurring at all odd quarter wavelengths combined with amplitude depressions at all non-resonant odd half-wavelength frequencies, which result in a poor sound quality and uneven power density over the pass-band.

It is desirable, therefore, to have a loudspeaker system that provides efficiency, enclosure volume, and low frequency bandwidth, and that also provides a significant improvement in large signal capability, particularly at the lowest one to two octaves of the audible spectrum, where the greatest demands for diaphragm excursion is the primary limitation in large signal capability.

A well-known class of low-frequency loudspeaker systems is a tapped horn (also known as a tapped pipe). In a tapped horn system, a single driver radiates energy from a front-side of the speaker cone into the throat of an expanding horn section, and the tap comprises the other side of the speaker cone as it radiates into a portion of the horn near the exit. FIG. 1B illustrates an example tapped horn as is presently known. As shown in FIG. 1B, the tapped horn 110 has a loudspeaker driver denoted LS1 that is mounted at or near the throat of a folded horn section comprising a first part 1 and a second part 2. The output 111 of the driver projects into the narrower throat area 1 and the horn expands and folds at least once so that at horn mouth where the sound 113 eventually exits, the horn wall is again adjacent to the driver. With the tapped horn shown in FIG. 1B, the front of the driver LS1 radiates into the throat of chamber 1, around the bend along chamber 2, past the rear of the driver and out the mouth of the horn. At approximately the ¼ wavelength frequency of the horn length, the driver resonates and cone motion is minimized. At the frequency that the horn is approximately ½ wavelength, the front wave of the driver is in phase with the rear wave of the driver so that the output is increased and reinforced at that frequency. This ¼ wave to ½ wave relationship maintains smooth response and reduces cone motion across the useful frequency range. The tapped horn derives useful output from both sides of the driver, which are summed in-phase, but conventional tapped pipes and horns of this type require at least one fold in the waveguide, causing fold losses and standing waves, and limit flexibility due to the front of the woofer needing to be coupled to the rear of the same woofer, with one mouth location.

It is further desirable, therefore, to have a low frequency speaker system that provides unfolded free-flowing waveguides that operate without fold losses and standing waves and that offers flexibility to provide a wide variety of advantageous configurations and newly adaptive parameters.

For purposes of the present description, the term "loudspeaker" means complete loudspeaker cabinet incorporating one or more loudspeaker drivers; the term "enclosure" means a cabinet, box, or other structure that encloses or partially encloses one or more drivers and that may include two or more waveguide chambers to form at least part of a loudspeaker; the term "driver" means a driver which converts electrical energy into sound or acoustic energy, and the terms driver and transducer may be used interchangeably, and the terms "cone" or "diaphragm" both refer to the moving element within a driver that vibrates to produce sound and that may have an asymmetrical shape (usually conical) to define a front side and rear (or back) side of the driver. While the driver may be used in either orientation of the front side of the driver or the rear (or back) side of the driver physically facing into a specific area of the loudspeaker chamber, the electrical input connections of the driver may also be wired for the front side providing a positive polarity orientation, or outward movement of the diaphragm with a positive waveform, or the electrical connections can be reversed such that the front side responds with a negative, or inward, movement of the diaphragm for a positive waveform. For purposes of description, the driver will be referred to as having a first polarity side and a second polarity side. The first polarity side of a driver may for example be the front side of the driver and the second polarity side of the driver may for example be the back side (or rear side) of the driver. The first polarity side of a driver may for example be the back side (or rear side) of the driver and the second polarity side of the driver may for example be the front side of the driver The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Embodiments of the cross-coupled regenerative waveguide system extend and improve on the concept of low-frequency woofer designs, such as present tapped horn systems. A cross-coupled waveguide architecture for low-frequency loudspeakers is described that provides a high degree of flexibility to create a wide variety of performance improvements over existing designs, and that may be packaged in a number of different configurations, such as straight in-line enclosure, curved or circular enclosure, or folded once or multiple times to achieve an optimal format for each type of application or environment. The cross-coupled waveguide architecture is used in a loudspeaker enclosure that has two drivers that transmit acoustic sound (resonant energy) directly and additively into two distinct waveguide columns (wave-column).

Each wave-column has a walled end (throat) and an open end (exit), and in a basic embodiment the wave-columns are pointed in opposite directions. With the same phase electrical connections for both drivers, the front (first polarity) surface of a first driver radiates into the throat of the first wave-column, past the rear (second polarity) surface of the second driver and exits out of the first wave-column mouth. The front surface of the second driver radiates into the throat of the second wave-column, past the rear surface of the first driver and exits out of the second wave-column mouth. The front of the first driver is cross-coupled to the rear of the second driver; and the front of the second driver is cross-coupled to the rear of the first driver. With the cross-coupled wave-columns, at the ¼ wavelength frequency of the effective waveguide length, both drivers resonate with the waveguides, and cone motion is minimized while acoustic output is maximized. At the frequency that the waveguide length is effectively ½ wavelength, the front wave of the first driver is cross-coupled to, and in-phase with, the rear wave of the second driver such that the output is increased, reinforced, and smoothed at that frequency. Further, at the ¼ wavelength frequency, corresponding to the distance between the two wave-column mouth outputs begin to have a type of acoustic mutual coupling continuing downward in frequency, which boosts acoustic output and may reduce cone motion at a critical maximum displacement frequency range.

Embodiments may also be envisaged in which the drivers are differently oriented, such that the rear surface of the first driver radiates into the throat of the first wave-column, past the front surface of the second driver and exits out of the first wave-column mouth, and such that the rear surface of the second driver radiates into the throat of the second wave-column, past the front surface of the first driver and exits out of the second wave-column mouth.

Embodiments may also be envisaged in which the drivers are wired out-of-phase relative to each other and are arranged in the same direction as each other, such that the front surface of the first driver radiates into the throat of the first wave-column, past the front surface of the second driver and exits out of the first wave-column mouth, and such that the rear surface of the second driver radiates into the throat of the second wave-column, past the rear surface of the first driver and exits out of the second wave-column mouth.

In an embodiment, the wave-columns are unfolded so the waveguides operate without standing wave resonances and fold losses, providing an increase output of a certain amount (e.g., about 1.5 dB). The enclosure including the wave-columns and drivers can be configured into various different shapes and orientations with respect to driver location, wave-column shapes, lengths, and layouts, and the addition of external circuitry to provide additional filtering and amplification functions.

Embodiments are yet further directed to methods of making and using or deploying the loudspeaker or speaker enclosure that features the cross-coupled columns and multi-driver architecture.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Figure 1A:
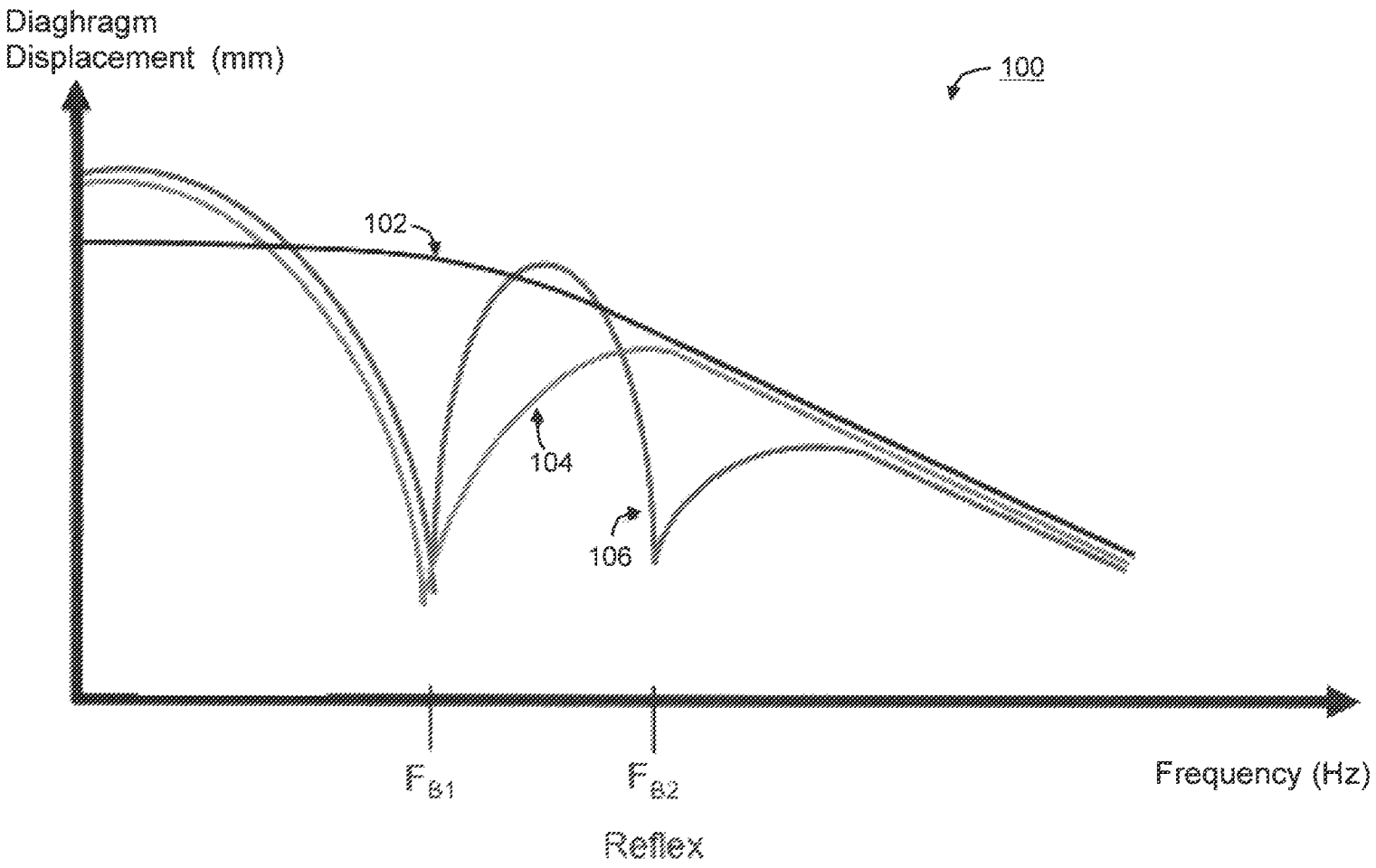
FIG. 1A (Prior Art)
FIG. 1A illustrates example diaphragm displacement versus frequency curves for some different enclosure types, as presently known.

Embodiments are described for a loudspeaker that uses two or more drivers in an efficient dual-horn arrangement where energy from both the front and the rear of each driver is used to minimize diaphragm displacement and increase output through cross-coupling via two adjacent waveguide columns (wave-columns).

Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Embodiments are directed to a low-frequency, high power density loudspeaker enclosure design for advancing low frequency acoustic output above that of current sealed and ported loudspeaker systems. In an embodiment, the enclosure design features two drivers placed within a folded column that interact to drive a pair of internal wave-columns to form a linear transitional air column that increases the acoustic output of a loudspeaker by reducing the required diaphragm displacement of the drivers for a given sound pressure level (SPL) over the passband. Such an enclosure may be referred to herein as a "cross-coupled regenerative wave column" (CCRWC enclosure) or "cross-coupled regenerative dual wave-column" enclosure, or simply as a "DWC" (dual wave-column) enclosure for brevity. One benefit of such an enclosure is that it inherently exhibits superior passive efficiency for a given low-frequency bandwidth and enclosure volume (e.g., +6 dB over an acoustic suspension, +3 dB over a bass reflex and bandpass systems). Another advantage is that it maximizes acoustic output while minimizing driver diaphragm excursion, thus providing superior large signal capability for a given driver cubic volume displacement.

Embodiments of the DWC enclosure use a unique form of interactive, anti-parallel wave-columns with multiple (usually two) drivers interconnecting the two wave-columns to create a hybrid anti-resonator/regenerative transition across the passband that equalizes the resonant and non-resonant modalities with acoustic summation and regeneration by way of acoustic cross-coupling of the multiple drivers within the wave-columns. This enclosure system and design leverages a combination of odd-quarter wavelength driver anti-resonant modes and odd-half-wavelength regeneration and in-phase acoustic summation of the four surface sides of the two drivers to significantly increase output and minimize driver diaphragm displacement over the most significant low frequency range of high cubic volume displacement requirements.

Figure 2:
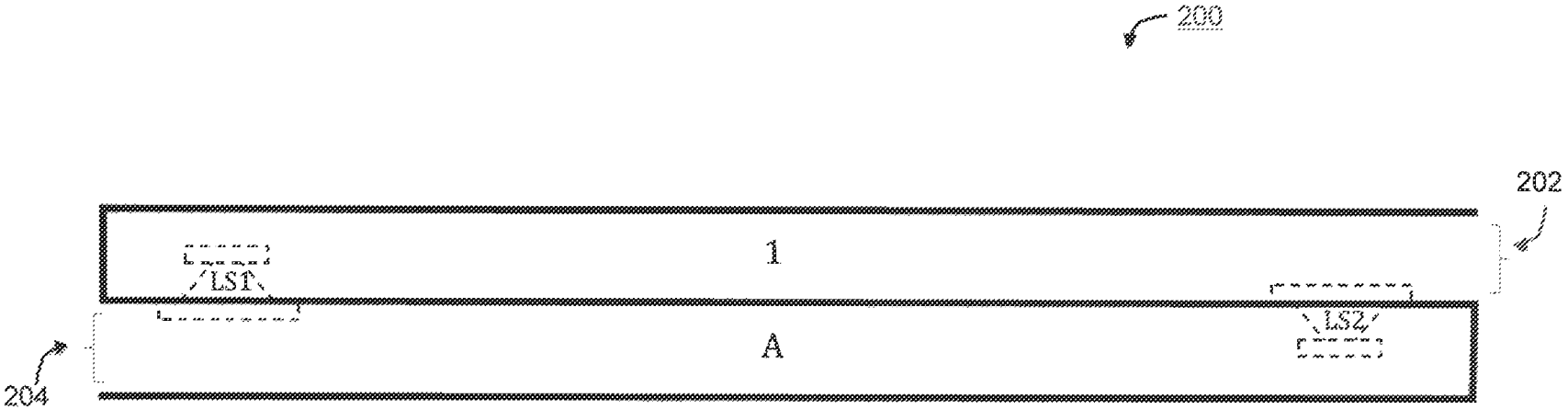
FIG. 2 illustrates a cross-coupled regenerative dual wave-column (DWC) enclosure for a subwoofer or other low-frequency bandpass loudspeaker, under some embodiments.

FIG. 2 illustrates a cross-coupled regenerative dual wave-column enclosure for a subwoofer or other low-frequency bandpass loudspeaker, under some embodiments. The enclosure 200 features at least two acoustically cross-coupled, interactive drivers (denoted LS1 and LS2), and a cross-coupled dual wave-column/dual driver architecture in which a first side of the first driver LS1 is coupled through the first wave-column A to a second side of the second driver LS2 in the second wave-column 1. A first side of the second driver LS2 is coupled through the second wave-column 1 to a second side of the first driver LS1 in the first wave-column A.

FIG. 2 illustrates a cross-coupled wave-column in a basic configuration where the rear-side of driver LS1 radiates into the throat of chamber 1, past the front-side of driver LS2, exiting out mouth 202. The rear-side of driver LS2 radiates into the throat of chamber A, and past the front-side of driver LS1, exiting out mouth 204. The diaphragms of the two drivers are thereby acoustically "cross-coupled" between the two wave-columns 1 and A. At the ¼ wavelength frequency of the wave-column length, both drivers realize an anti-resonance within the wave-columns that exhibit a wave resonance so that the cone motion of each driver is minimized, and output is maximized. At the frequency in which the length of the wave-column corresponds to ½ wavelength, the front wave of the first driver (LS1) is cross-coupled to, and in-phase with, the rear wave of the second driver (LS2) such that the output is increased, reinforced, and smoothed at that frequency. Further, at the ⅓ wavelength frequency (approximately 1.3×Fc) the two mouth outputs 202 and 204 begin to exhibit and acoustic mutual coupling effect that boosts acoustic output and may reduce cone motion at the critical maximum displacement frequency. The unfolded, free-flow wave-columns 1 and A also operate without fold losses, providing an increase in output (e.g., of about 1.5 dB).

The example enclosure design of FIG. 2 produces free flowing, lossless regenerative wave-columns. The linear wave-column is produced without folds and may eliminate the need to use lossy absorption material in the loudspeaker that may be required in folded systems to minimize standing waves that can be formed between reflective column ends in a folded column, as in column "1" in the prior art device of FIG. 1B. It provides independent placement of primary and regenerative driver diaphragm LS1 and LS2 surfaces. It further provides a combination of resonant mode operation at effective column lengths of odd quarter wavelengths and diaphragm surface summations at and near half wavelength frequency range, and one third wavelength mutual-coupling corresponding to the distance between wave-column mouths at high-excursion frequency (~1.3 Fc). The enclosure design 200 also provides a range of flexible configurations and parameter sets for performance enhancements, and can be packaged in small and flexible height and depth dimensions, depending on system requirements and constraints. Thus, the flexibility of enclosure containing the wave-columns and two cross-coupled drivers can be used to provide a wide variety of advantageous configurations and newly adaptive parameters.

In the example embodiment described above with reference to FIG. 2, the back side of the first driver LS1 radiates into the throat of the first chamber 1 past the front side of the second driver LS2, while the back side of the second driver LS2 radiates into the throat of the second chamber A past the front side of the first driver LS1. In such example embodiments, both drivers LS1 and LS2 may for example be provided with the same phase electrical connections.

Example embodiments may also be envisaged in which the orientation of both drivers LS1 and LS2 are reversed compared to FIG. 2 such that instead the front sides of the drivers LS1 and LS2 radiate into the throats of the first and second chambers respectively. In such example embodiments, both drivers LS1 and LS2 may for example be provided with the same phase electrical connections.

Figure 4:
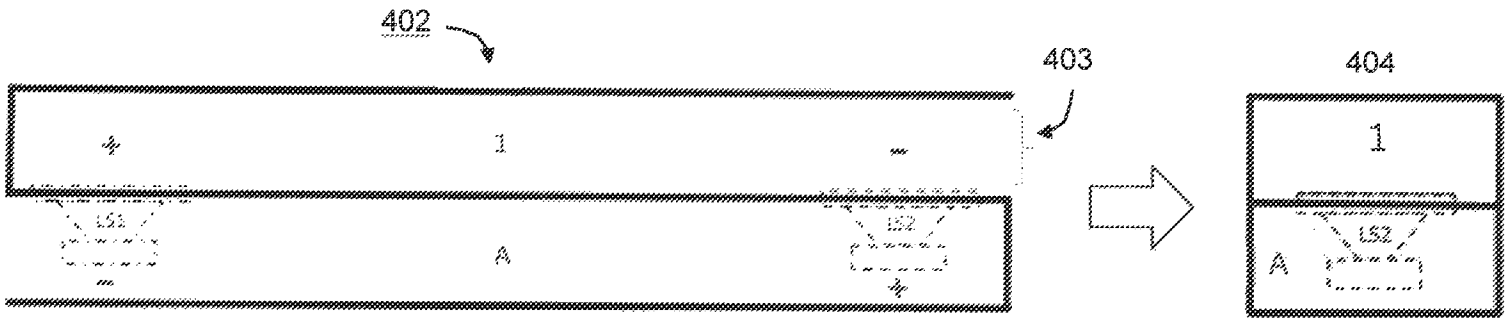
FIG. 4 illustrates a constant cross-section of a basic DWC enclosure under an embodiment.

Example embodiments may also be envisaged in which the orientation of only the first driver LS1 is reversed compared to FIG. 2 such that the front side of the first driver LS1 radiates into the throat of the first chamber 1 past the front side of the second driver LS2, while the back side of the second driver LS2 radiates into the throat of the second chamber A past the back side of the first driver LS1. In such example embodiments, the first and second drivers LS1 and LS2 may for example be wired out-of-phase relative to each other. Such an example is shown in FIG. 4.

Operational Overview

Figure 3:
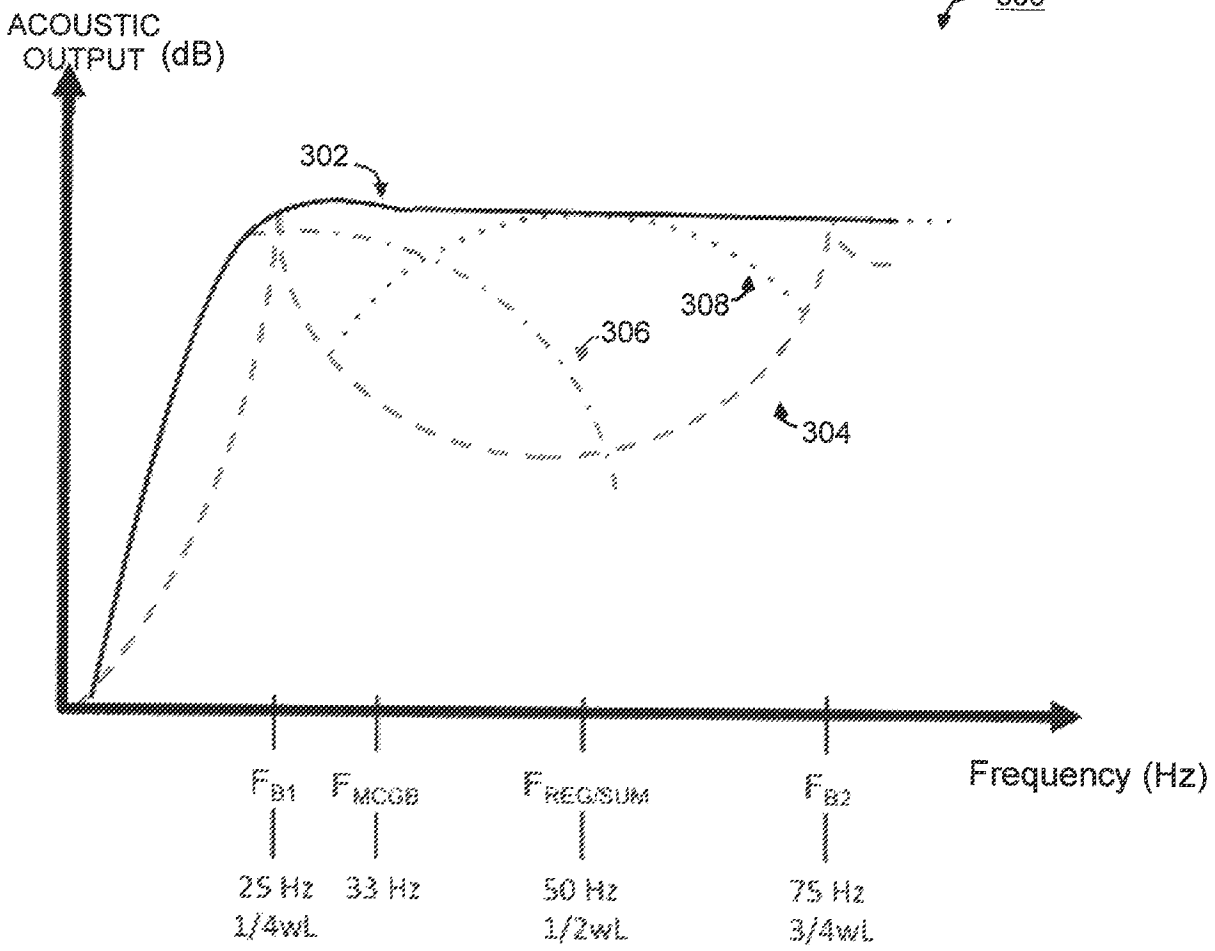
FIG. 3 is a graph that illustrates the different interactive modes of the DWC enclosure, under some embodiments.

As shown in FIG. 2, the DWC enclosure utilizes the acoustic output of all four sides of two driver (e.g., woofer driver) diaphragms in a synchronized manner to drive a pair of internal wave-columns. By doing so, a new type of linear transitional air-column is realized that significantly increases acoustic output capability by reducing the required diaphragm displacement of the drivers for a given sound pressure level over the passband. To illustrate operational characteristics and component interactions, an example DWC subwoofer using enclosure 200, with example column lengths of 3.44 meters, is explored over the most excursion critical portion of the operating range of 25 Hz to 75 Hz, as shown in the graph of FIG. 3.

While there are many configuration options to optimizing the architecture, a basic description of the structure is that of dual, anti-parallel acoustic air-columns, with optimized cross-section area from beginning to end, with a specific relationship to the surface area of the driver diaphragms. With reference to FIG. 2, a first side of the first driver (LS1) diaphragm is positioned to drive the beginning, or throat (the closed end), of wave-column 1, emitting acoustic energy through the length of wave-column 1 to its opening, or mouth 202. To engage cross-coupling, the second side of the diaphragm of the second driver LS2 is positioned to produce acoustic energy near the open end of wave-column 1, with a portion of the energy emitted out the exit or mouth 204, and, the remainder back to the beginning of wave-column 1 for reflective regeneration back to the exit of wave-column 1. To complete the cross-coupling effect, the first side the diaphragm of driver LS2 is positioned to drive the beginning of the other wave-column A emitting acoustic energy through the length of wave-column A to its opening 204. The second side of the diaphragm of driver LS1 is positioned to transmit acoustic energy from near the open end of wave-column A, out the exit 204, and back to the beginning of wave-column A for regeneration. Utilizing the interface of the drivers to the wave-columns, the system operates by seamlessly shifting among three modes of operation to sustain at least a certain gain enhancement (e.g., +6 dB to 9 dB) and a certain reduction (e.g., approximately 10 dB less) of cone displacement and distortion across the useful operating range of the system.

In the current example system, starting at 25 Hz, the first side of the diaphragm of the first and second drivers, LS1 and LS2, drive the length of the wave-columns 1 and A respectively, in a manner that each wave-column operates as quarter wave tuned wave-column, with the energy within the wave-columns being magnified by the resonant loading of the enclosure to provide a more efficient acoustic impedance match to the external environment at the exit of each wave-column. At a frequency of or near 25 Hz, drivers LS1 and LS2 are loaded by the tuned wave-columns, substantially reducing the cone motion and distortion (e.g., by a factor of approximately ten dB) while generating the magnified energy (approximately 6 to 9 dB more than the direct output of the driver cone) through the exit of the wave-column 1 and A openings 202 and 204. Because the cone displacement is minimized, the acoustic output of the second sides of the driver diaphragms realize no significant acoustic contribution to the output of the system in the frequency range around 25 Hz, as the majority of acoustic power is resonant power.

As the system moves up in frequency it transitions from the first operational mode as a quarter-wave tuned wave-column or "direct wave-column resonator" to the second operational mode of a "half-wave regenerator" and an inclusion of in-phase summation of the acoustic output of all four of the diaphragm surfaces. As the system changes from 25 Hz to 50 Hz it transitions from the first mode to the second mode, with the two modes sharing the interactions to maintain the 6 to 9 dB of gain and the substantial diaphragm excursion reduction. In effect, as one mode weakens the next mode strengthens, resulting in a smooth transition without significant amplitude discontinuities. As an additional aspect of the example cross-coupled system, at approximately 1.3×25 Hz ($F_{B1}$) or 33.75 Hz, the two spaced wave-column exits 202 and 204 engage in a third mode of mutual coupling, which increases output and may reduce displacement of the driver diaphragms at the frequency range of greatest in-band diaphragm displacement.

In the example system, the second, regenerative mode, reaches full dominance at 50 Hz. The second mode is caused by the first side of driver LS1 diaphragm driving (non-resonant) acoustic energy into the full length of the wave-column 1, and the first side of driver LS2 diaphragm driving (non-resonant) acoustic energy into the full length of wave-column A, with the dual acoustic energy streams exiting the openings of each of the two wave-columns.

At and near the half-wavelength frequency (50 Hz) the acoustic output of the second side of driver LS1 diaphragm is divided, with one portion of it exiting the wave-column A opening, and the remaining amount traveling down the length of the wave-column A to the closed end where the first side of driver LS2 diaphragm resides. Because wave-column A is operating as a half wave regenerator at 50 Hz, the sound waves from the second side of the diaphragm of driver LS1 arrives at the beginning (closed end) of wave-column A in-phase with the output of the first side of the diaphragm of driver LS2. So, as the first side of the diaphragm of LS2 is launching its waveform down the length of wave-column A, the output of the second side of the diaphragm of driver LS1 arrives at wave-column A beginning and is reflected back down wave-column A in phase with the first diaphragm side driver LS2 output. At or near, 50 Hz, the total acoustic output is the sum of six acoustic sources from each wave-column. The six acoustic sources are as follows:

(1) The first diaphragm side non-resonant acoustic output of driver LS1.

(2) The second diaphragm side acoustic output of driver LS2.

(3) The regenerative output of the second diaphragm side of driver LS2 traveling down to, and reflecting back from, the closed end of wave-column 1, arriving in-phase with all acoustic sources, at the exit of wave-column 1.

(4) The first diaphragm side non-resonant acoustic output of driver LS2.

(5) The second diaphragm side acoustic output of driver LS1.

(6) The regenerative output of the second diaphragm side of driver LS1 traveling down to, and reflecting back from, the closed end of wave-column A, arriving in-phase with all acoustic sources, at the exit of wave-column A.

In an embodiment, these six acoustic outputs sum to maintain a +6 to +9 dB (up to 12 dB in some embodiments) of gain as the second mode acoustically cross-couples the diaphragms through the dual wave-columns to minimize cone motion while maintaining an increased acoustic output-to-cone displacement ratio. Moving up from 50 Hz to 75 Hz, the system switches from mode 2, "regenerative" back to direct resonant mode one as the system transitions to a ¾ wave resonant wave-column mode, corresponding to the effective length of the wave-column, which enhances system output and reduces cone displacement as in the first ¼ wave wave-column mode. From 75 Hz towards 100 Hz, the system starts to transition out of direct resonant mode to, in some embodiments, another regenerative mode and may be crossed over to match an upper range system. Alternatively, the cross-coupled wave-columns may be adapted for greater high frequency bandwidth and higher cross over frequency, with a further repeat of the multimodal transitions. Thus, at the lowest frequency of operation, the system begins with a ¼ wave direct resonator fully dominating at 25 Hz, and moves to approximately 37 Hz where the direct resonator shares its modal activity equally with the ½ wave regenerator, and then moves on to 50 Hz wherein the ½-wave regenerator mode fully dominates. As it moves up in frequency, it transitions to shared modalities at approximately 50 Hz, with full direct resonator mode dominating again at 75 Hz, and then in some embodiments the transition starts over and continues upward in frequency. Throughout the pass-band of the system, when properly aligned, the transitions are seamless with substantially flat amplitude response over the operating range of the subwoofer.

FIG. 3 is a graph that illustrates the different interactive modes of the DWC enclosure, under some embodiments. FIG. 3 illustrates the acoustic output of the loudspeaker versus frequency for each operational mode relative to example frequencies of 25 Hz, 33 Hz, 50 Hz, and 75 Hz for the example embodiment described above. In graph 300, curve 302 represents the output after a full summation of the outputs from each driver; curve 304 represents the output for the odd ¼-wave wave-column resonance/driver anti-resonance mode corresponding to the effective length of the wave-column; curve 306 represents the mutual coupling gain band mode; and curve 308 represents the ½ wave regeneration and summation mode under an example embodiment. In the example graph, $F_{B1}$ and $F_{B2}$ correspond to the first and third quarter wave resonances, respectively, FMCGB (frequency mutual coupling gain band) corresponds to the mutual coupling frequencies of the two opening exits, and FREG/SUM (Frequency regeneration/summation) corresponding to the ½-wavelength center frequency.

Figure 5:
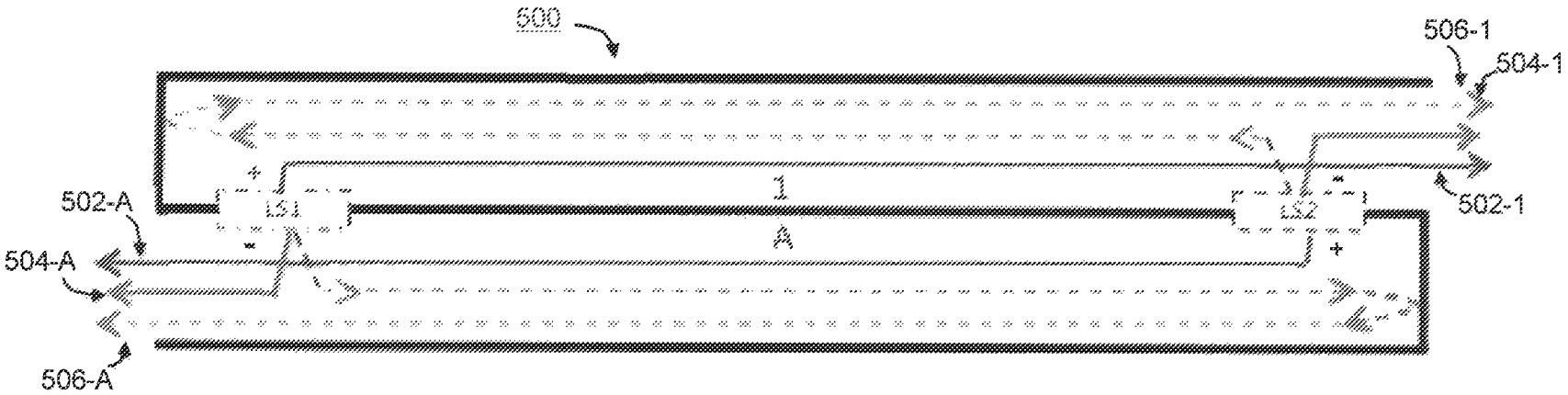
FIG. 5 shows an example of the acoustic flow in a DWC enclosure for the outputs and summations at ¼ and ½ wavelengths, under some embodiments.

FIGS. 4 and 5 illustrate the configuration and acoustic flow within a DWC enclosure for the example modes described above. FIG. 4 illustrates a basic constant cross-section of DWC enclosure 402 with the first and second surfaces of each driver LS1 and LS2 denoted as either a plus (+) or minus (−) polarity, in this case with the one driver wired out-of-phase relative to the other. The end view 404 of enclosure 402 illustrates how the end view from 403 shows wave guide chamber 1 as open and wave guide chamber A as closed. FIG. 5 shows an example of the acoustic flow for the outputs and summations at ¼ and ½ wavelengths under an embodiment. In FIG. 5, lines 502 represent the direct output at all frequencies enhanced at each odd ¼ wavelength, lines 504 represent the direct output at all frequencies with enhanced summation at ½ wavelength, and lines 506 represent the summation at each odd ½ wavelength. The acoustic flow for the example of FIG. 5 is as follows: the front (+) of LS1 radiates resonant energy down wave-column 1 at every odd ¼ wavelength frequency, past the back of LS2 and exits wave-column 1 as shown by line 502-1. The front (−) of LS2 radiates directly out the mouth of wave-column 1 as shown by line 504-1 and also back to down wave-column 1 to the throat of wave-column 1 to reflecting back out wave-column 1, as shown by dashed line 506-1 to regenerate as in phase summation with the front side of LS1 and the backside of LS2 at every odd ½ wavelength frequency.

For the other wave-column (A), the back (+) of LS2 radiates resonant energy at every odd ¼ wavelength frequency down wave-column A, past the back of LS1 and exits wave-column A as shown by line 502-A. The back (−) of LS1 radiates directly out the mouth of wave-column A as shown by line 504-A. It also radiates back to down wave-column A to the throat of wave-column A, as shown by dashed line 506-A to reflect and regenerate as in phase summation with the front side of LS2 and the backside of LS1 at every odd ½ wavelength frequency.

Figure 1B:
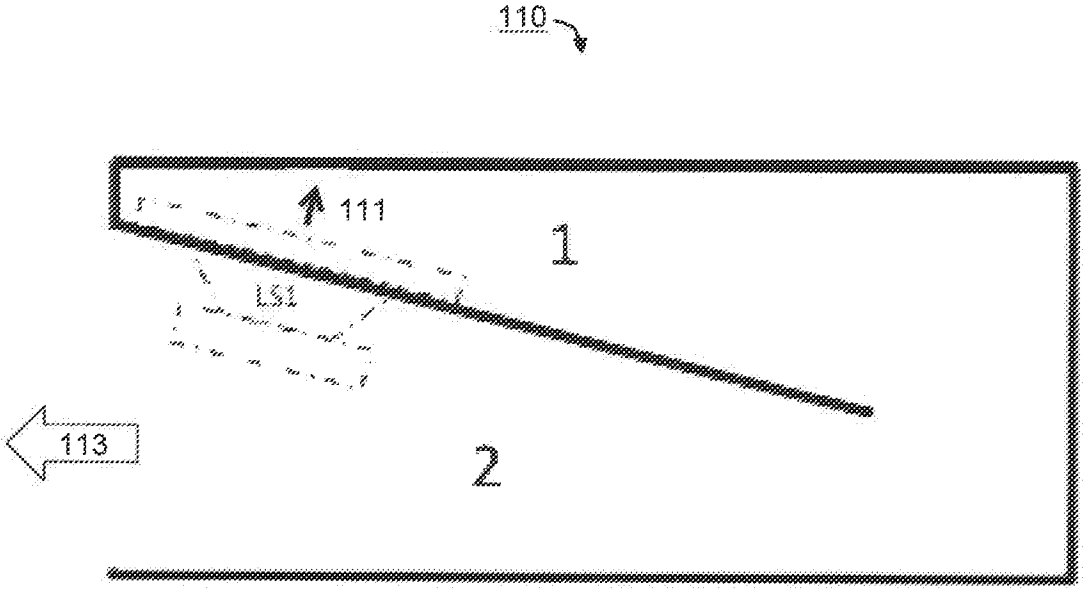
FIG. 1B (Prior Art)
FIG. 1B illustrates an example tapped horn subwoofer system as is presently known.
Figure 6:
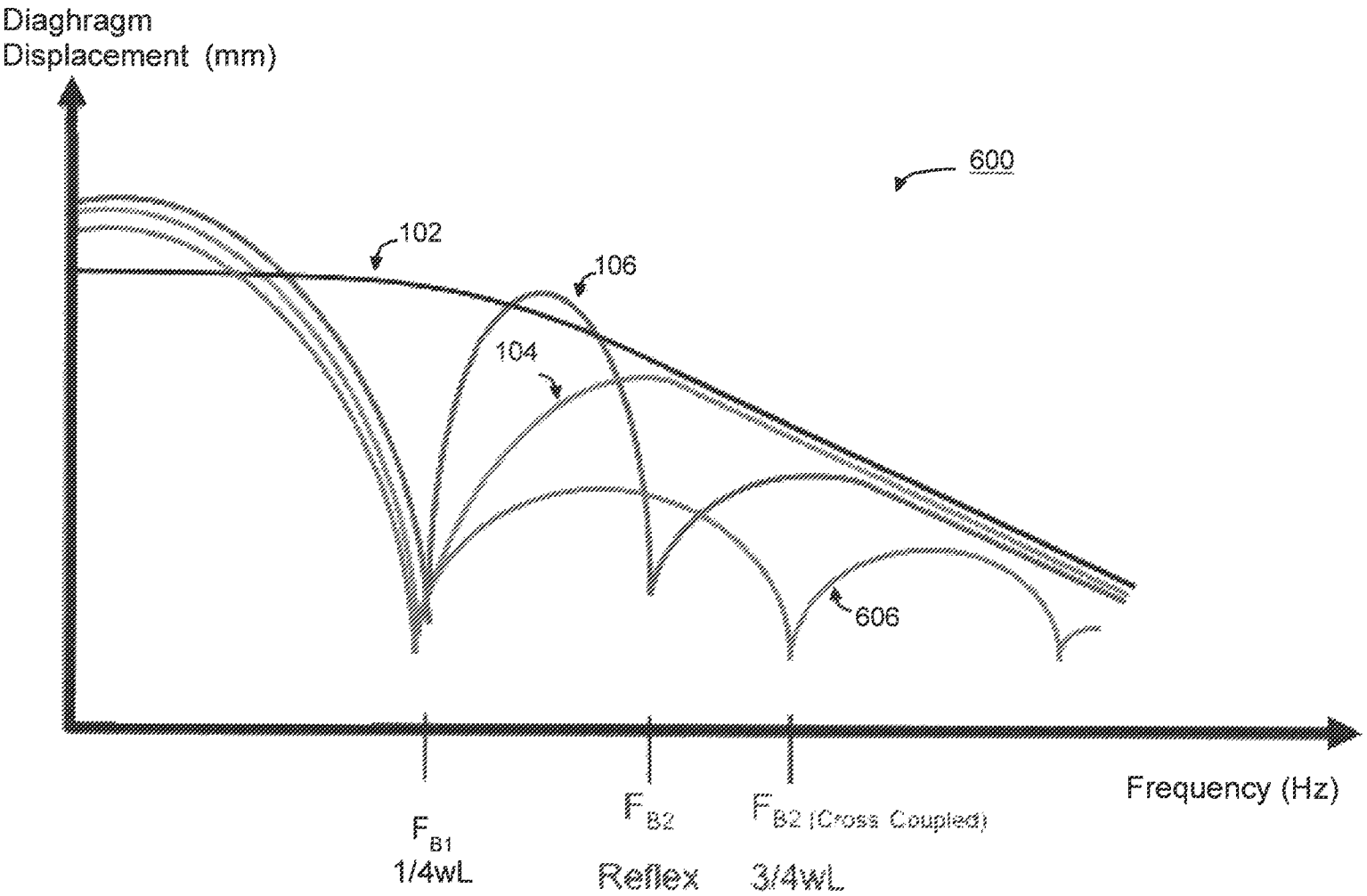
FIG. 6 illustrates the example diaphragm displacement versus frequency curves for the enclosure types of FIG. 1 in comparison with a DWC enclosure, under some embodiments.

The DWC enclosure 500 of FIG. 5 shows the operation of the multi-modal, wavelength transitional, dual column architecture that provides close cross-coupling between the different surfaces of the two drivers. This system provides increased output for a given diaphragm excursion maintained over the passband. Diagram 600 of FIG. 6 illustrates the example diaphragm displacement (in mm) versus frequency (Hz) curves for the enclosure types of FIG. 1A in comparison with a DWC enclosure, under some embodiments. As can be seen in FIG. 6, the curve 606 for the DWC enclosure shows that for a given acoustic output, this enclosure requires significantly less driver diaphragm displacement compared to the presently known systems (curves 102, 104, and 106) as shown in FIG. 1A.

FIG. 5 illustrates an example configuration of the DWC enclosure in which the two wave-columns are parallel to each other, of the same dimension, and uniform with respect to cross-sectional area and shape. It also shows a configuration in which the drivers are mounted in opposition to each other with respect to their principal direction of projection, and at an equal distance from their respective wave-column exits. Many different variations of the DWC enclosure with respect to wave-column shape, area, configuration, and so on, as well as driver position and orientation are also possible. As such, the constant cross-sectional area wave-columns of FIG. 5 may represent a basic reference configuration in which the neutral effective wave-column length equals the actual length plus an end correction. Examples of some possible configurations under such alternate embodiments are provided below.

It should also be noted that the drivers themselves may be configured in any number of practical ways, such as different size, type, power rating, and so on. Each driver may represent a driver array comprising two or more drivers arranged in a particular spatial pattern (e.g., line, square, etc.) The two drivers LS1 and LS2 may be the same type and size driver, or they may be different depending on the configuration of the enclosure and the two wave-columns so as to produce specifically tailored sound characteristics.

Alternative Configurations

Figure 7B:
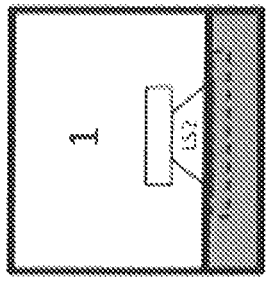
FIG. 7B illustrates an end view of the DWC enclosure of FIG. 7A.
Figure 7A:
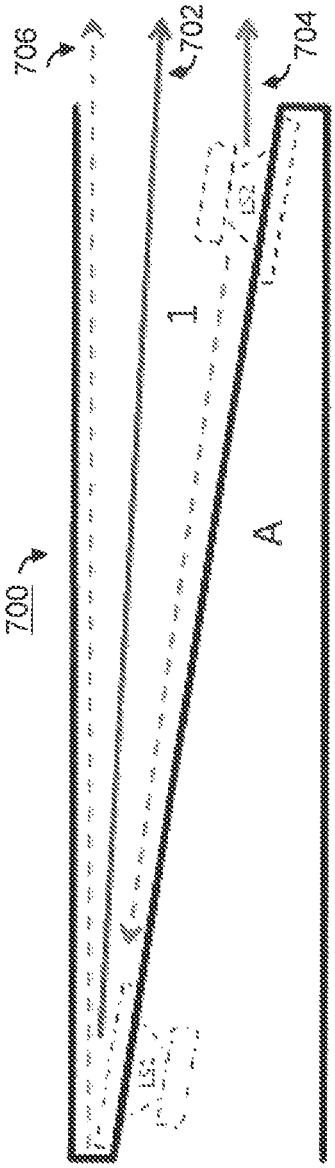
FIG. 7A illustrates a side view of a DWC enclosure under an embodiment in which the wave-columns are flared.

FIGS. 7A and 7B illustrate a DWC enclosure under an embodiment in which the wave-columns are flared. FIG. 7A is a side view of enclosure 700 in which the wave-column 1 is shown having an increasing cross-sectional size (flared-out) from driver LS1, and wave-column A is flared out in the opposite direction. FIG. 7B shows an end view of the enclosure 700 as seen looking in through the exit of wave-column 1. With respect to the acoustic flow in this enclosure, line 702 represents the direct output at all frequencies enhanced at each odd ¼ wavelength; line 704 represents the direct output at all frequencies with enhanced summation at ½ wavelength; and line 706 represents the enhanced summation at each odd ½ wavelength. The positive (increasing) flare of the wave-columns effectively shortens the wave-column length and enhances the output above the quarter wave tuning frequency and extends the upper range bandwidth. In this example of a "positive-flare" wave-column, the effective acoustical length is reduced such that it is somewhat longer than the physical length that directly corresponds to ¼ wavelength. Alternatively, for a given physical length the positive flare structure will realize its "¼ wavelength" resonant frequency at a somewhat higher frequency than the physical length would suggest.

Figure 8A:
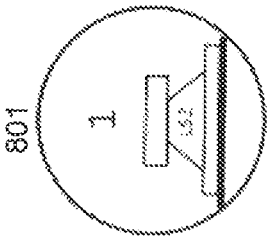
FIG. 8A illustrates an end view of a DWC enclosure under an embodiment in which the wave-columns are flared and circular in cross-section.
Figure 8B:
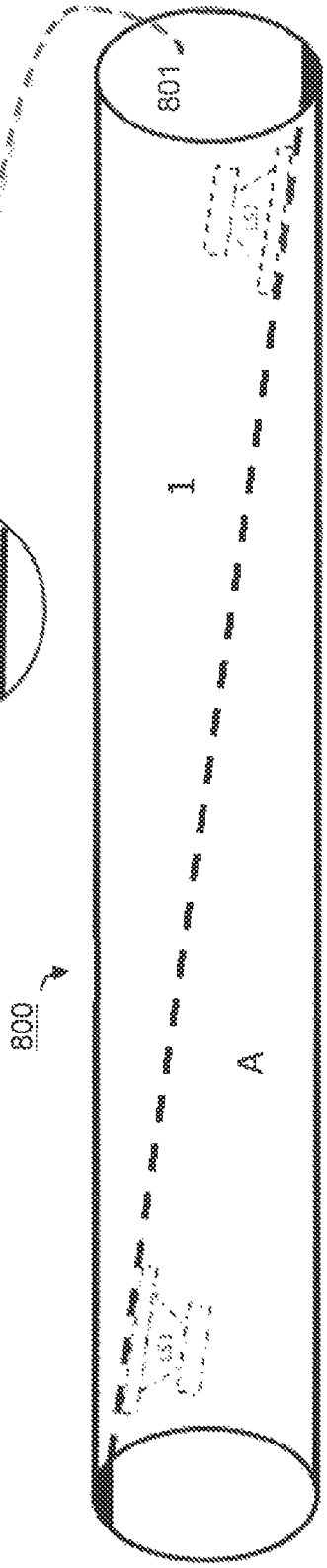
FIG. 8B illustrates a side view of the DWC enclosure of FIG. 8A.
Figure 9C:
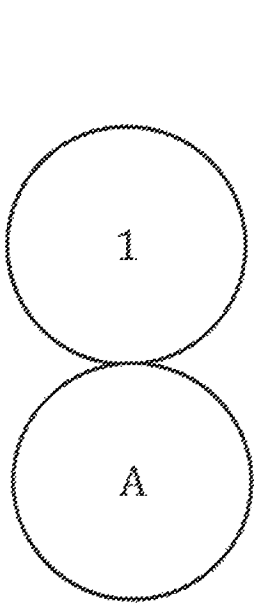
FIG. 9C illustrates a tubular DWC enclosure with the wave-columns arranged in a linear arrangement.
Figure 9B:
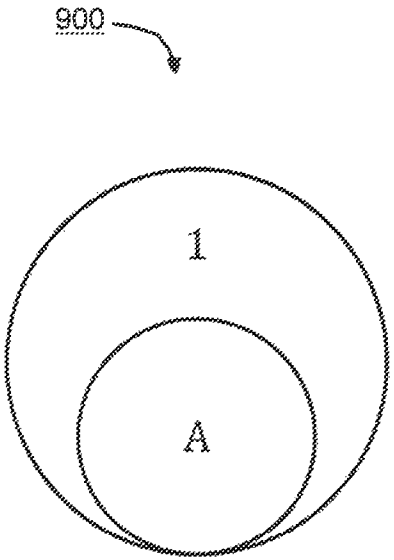
FIG. 9B illustrates a tubular DWC enclosure with the wave-columns arranged in a second concentric arrangement.
Figure 9A:
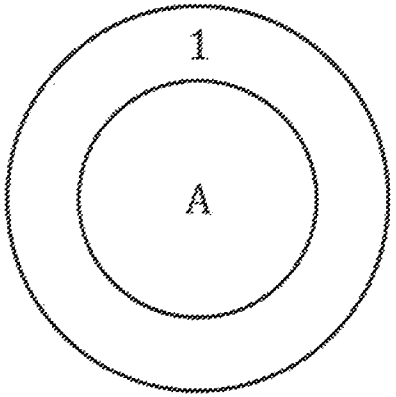
FIG. 9A illustrates a tubular DWC enclosure with the wave-columns arranged in a first concentric arrangement.

The embodiments described so far have shown the cross-sectional shape of the wave-columns as being rectangular or square in shape, but embodiments are not so limited, as many other shapes are also possible. FIGS. 8A and 8B illustrate a DWC enclosure under an embodiment in which the wave-columns are flared and circular in cross-section. FIG. 8A illustrates an end view of DWC enclosure 800 in which the enclosure is effectively fashioned into a circular tube so that the shape looking in to wave-column 1 presents a circular cross-section. FIG. 8B is a side view of the DWC enclosure 800 looking into end 801 showing the positive flaring configuration of the two wave-columns 1 and A. As a positively flared configuration, the acoustic flow of this enclosure would be substantially the same as that shown in FIG. 7A for the square-cross section flared enclosure. The circular tube construction can strengthen the structure and reduce weight, and in certain cases may reduce construction complexity. Various different configurations of the tube-based enclosure are possible with respect to the relative positions of the wave-columns 1 and A. FIGS. 9A-C illustrate some example alternate embodiments 900 of the circular cross-section enclosure. FIG. 9A illustrates the wave-columns 1 and A arranged in a first concentric arrangement, while FIG. 9B illustrates the wave-columns 1 and A arranged in a second concentric arrangement. FIG. 9C illustrates the wave-columns 1 and A arranged in a linear fashion, such as adjacent to one another vertically, though other orientations are also possible, such as horizontally, angled, and so on.

Figures 10A, 10B, 10C, 10D:
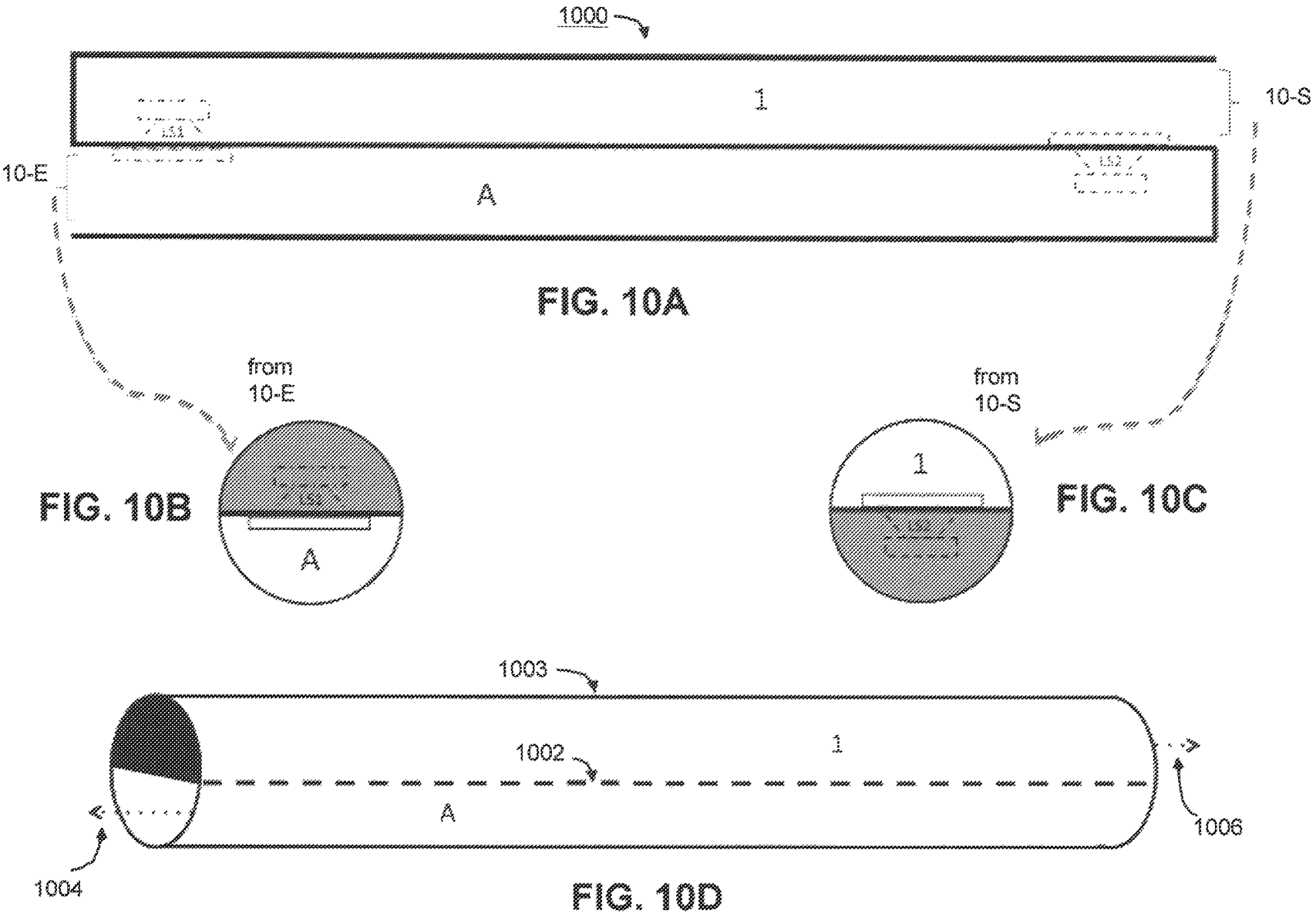
FIG. 10A illustrates a configuration of a tubular DWC enclosure in which the two wave-columns are of uniform area throughout their lengths, under some embodiments.
FIG. 10B is a first end view of the tubular DWC enclosure of FIG. 10A.
FIG. 10C is a second end view of the tubular DWC enclosure of FIG. 10A.
FIG. 10D illustrates a side view of the tubular DWC enclosure of FIG. 10A.

The embodiment of FIGS. 8A and 8B illustrated tubular DWC enclosure in a flared configuration, however, a nonflared configuration may be considered more basic. FIGS. 10A-D illustrate a tubular DWC enclosure in a basic configuration in which the two wave-columns are of uniform area throughout their lengths. FIG. 10A illustrates a configuration of a tubular DWC enclosure 1000 in which the two wave-columns 1 and A are of uniform area throughout their lengths. FIG. 10B is an end view of the tubular DWC enclosure of FIG. 10A as seen from end 10-E showing the circular cross-section as seen looking into the exit of wave-column 1, and FIG. 10C is an end view of the tubular DWC enclosure of FIG. 10A as seen from end 10-S showing the circular cross-section as seen looking into the exit of wave-column A FIG. 10D illustrates a side view of the outside or outer surface 1003 of tubular DWC enclosure of FIG. 10A and showing the tubular construction of the enclosure with dashed line 1002 within enclosure 1000 showing the position of the internal baffle separating the two wave-columns 1 and A. Dashed lines 1004 and 1006 illustrate the direction of sound projection out of the ends 10-E and 10-S, respectively of enclosure 1000.

The embodiments described so far have included loudspeaker enclosures that are straight along an axis between the throats and exits of the wave-columns. In an alternative embodiment, the enclosures may be curved, such as curved tubes or curved box section channels. The use of curved enclosures allows the sound from both wave-columns to be projected in the same or roughly the same direction. It also reduces the space requirements for the loudspeaker and allows it to be used in different environments, such as home theatre or projection room applications.

Figure 11:
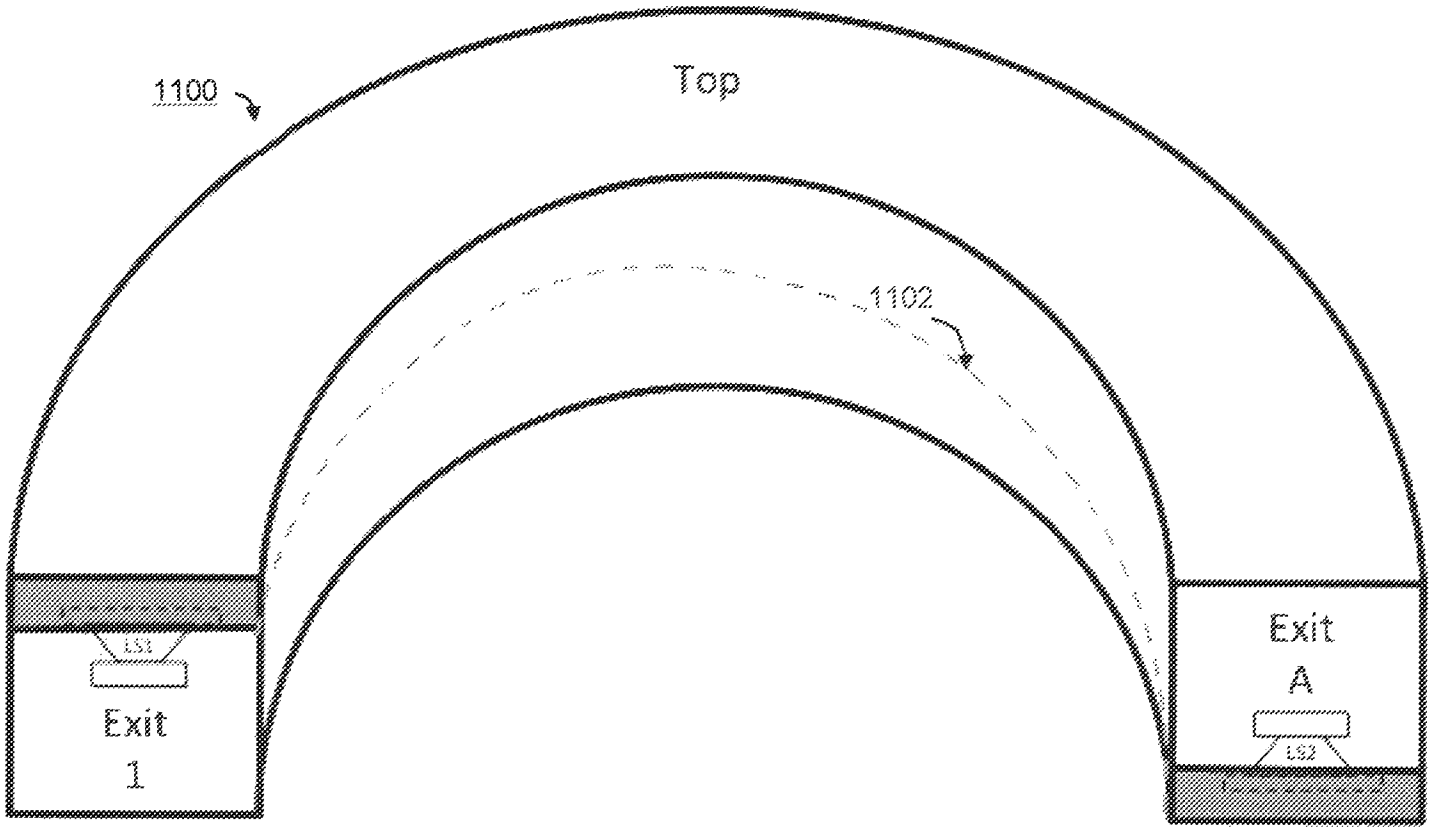
FIG. 11 illustrates a curved DWC enclosure under a first embodiment.

FIG. 11 illustrates a perspective view of a curved DWC enclosure under a first embodiment. As shown in FIG. 11, enclosure 1100 is a square cross-section structure with an internal baffle 1102 that extends downward from an upper portion near the exit of wave-column 1 to a lower portion of the exit of wave-column 2 so that the two wave-columns flare outward, such as shown in FIG. 7A. While the embodiment of FIG. 7A is straight, the enclosure is 1100 of FIG. 11 is curved so that the two exits 1 and A project together in a forward direction. The curvature may be varied so that they project sound exactly parallel to each other or slightly away or toward each other. Similarly, the cross-section of the enclosure may be circular instead of square, or of any other appropriate and practical shape.

Figure 12:
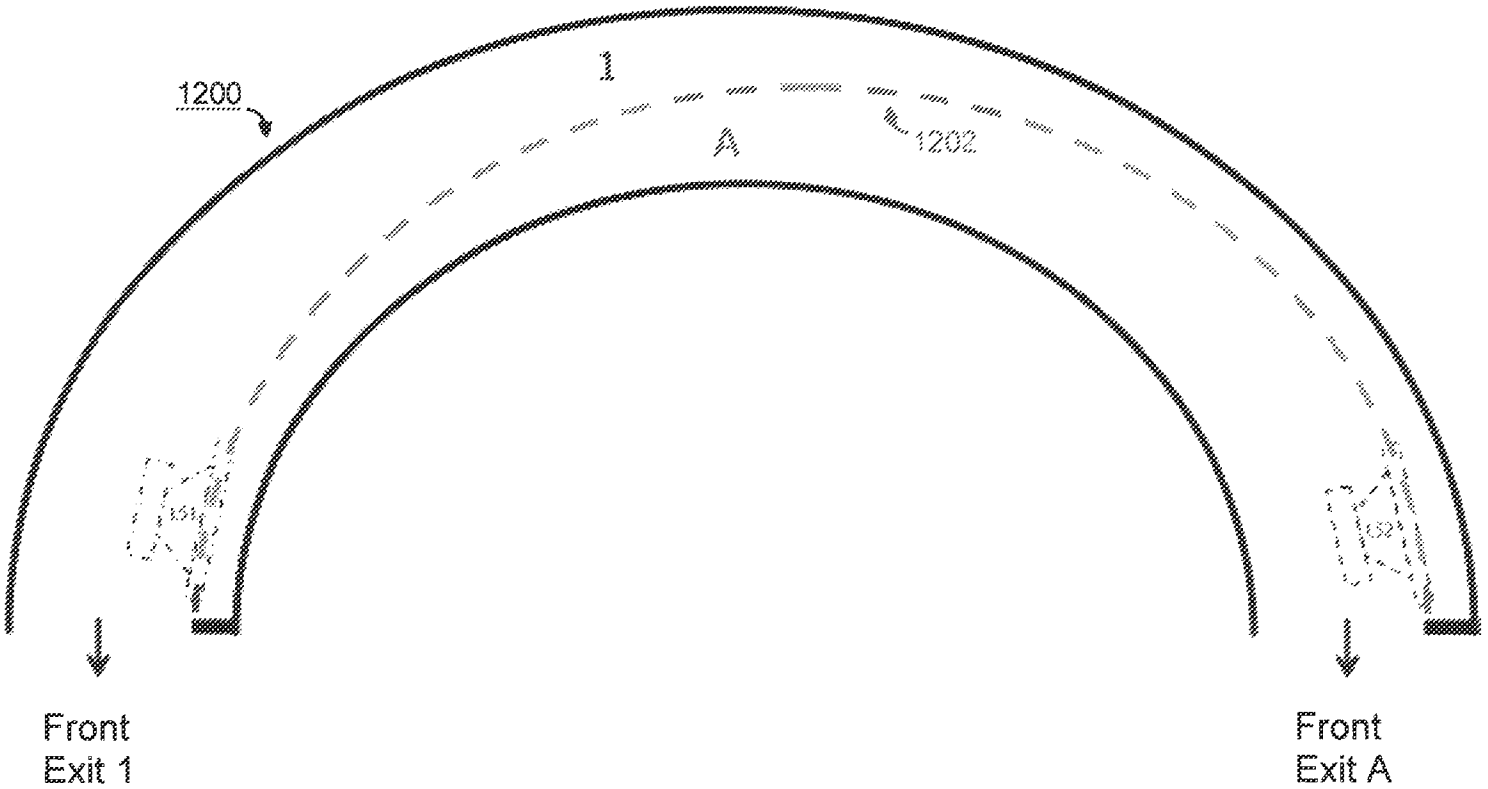
FIG. 12 illustrates a curved DWC enclosure under a second embodiment.

The configuration of enclosure 1100 represents an over-under type of curved configuration in which the two drivers LS1 and LS2 are mounted on the baffle 1102 to project respectively on an upper and lower surface of the enclosure. In an alternative embodiment of the curved DWC enclosure, the drivers may be mounted so that they fire toward opposite sides of the enclosure in a front-back type of configuration. FIG. 12 illustrates top view of a curved DWC enclosure under this type of alternative embodiment. As shown in FIG. 12, enclosure 1200 has an internal baffle 1202 that runs from an inside portion of the exit for wave-column 1 to an outside portion of the exit for wave-column A, thus forming the two flared out wave-columns. The drivers LS1 and LS2 are mounted such that they fire toward a respective inside wall of the enclosure, as can be seen in FIG. 12.

The curved configurations of FIGS. 11 and 12 provides an enclosure that eliminates any sharp bends throughout the enclosure, including at the exits. It also allows sound from both wave-guides to be projected in parallel or nearly in parallel depending on the amount of curvature imparted to the enclosure. Such a configuration is useful for projecting sound in a specific direction, such as from under a monitor or screen out to a specific listening spot. This may be useful if the audio content played through the loudspeaker is of relatively higher frequencies and not necessarily omnidirectional as is the case with very low frequency sound.

Figure 13:
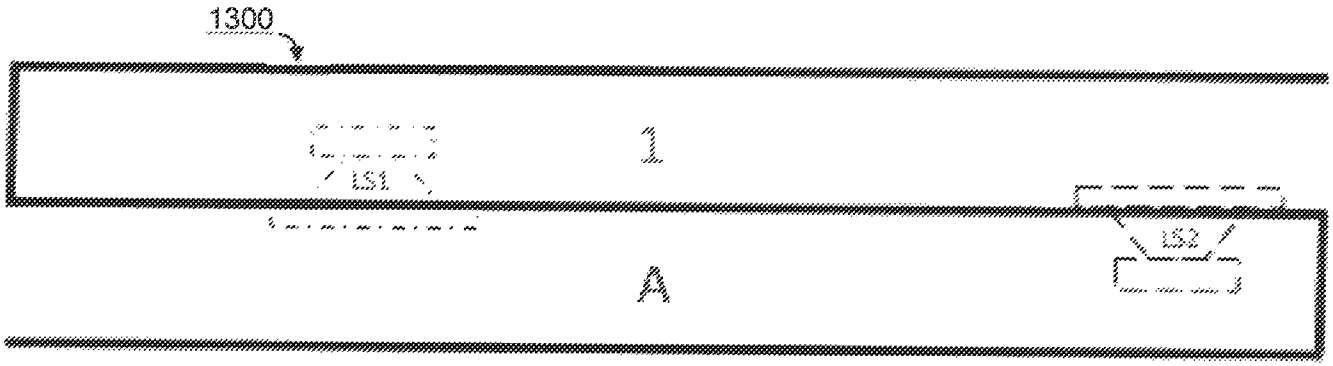
FIG. 13 illustrates an asymmetric DWC enclosure for a uniform dual wave-column, under some embodiments.
Figure 14:
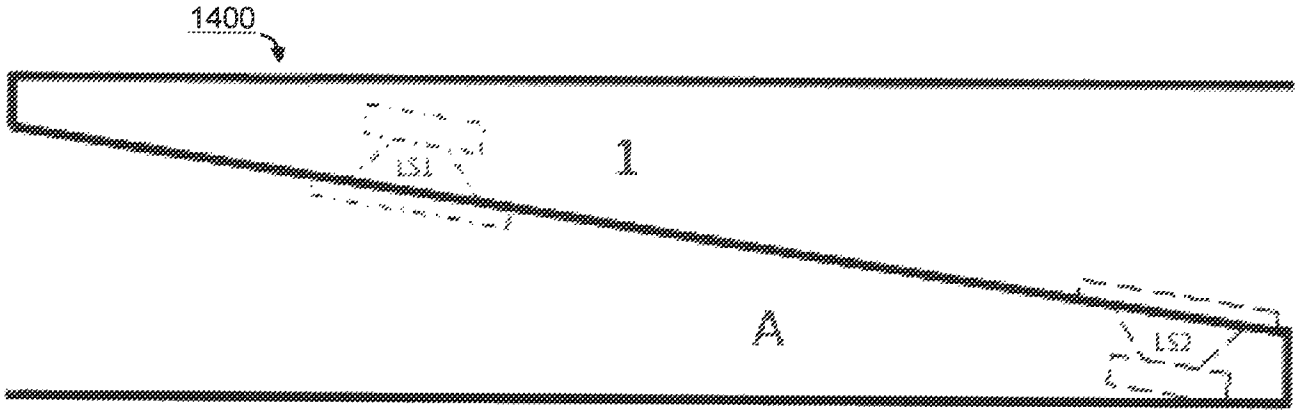
FIG. 14 illustrates an asymmetric DWC enclosure for a flared dual wave-column, under some embodiments.

Although the DWC enclosure may be configured in various ways with regard to the enclosure size, shape, and configuration of the cabinet structure itself, other elements of the loudspeaker may also be changed to provide other alternate enclosure configurations. One significant variable is the placement and orientation of the drivers in the enclosure. As shown in FIG. 2, a basic embodiment of the DWC enclosure has the two drivers LS1 and LS2 placed symmetrically within the enclosure such that they are located at the same respective distance to the closed and open portions of each wave-column. In one or more alternative embodiments, the drivers may be placed in an asymmetrical arrangement where one driver is nearer to or further from a column exit than the other driver. FIG. 13 illustrates an asymmetric DWC enclosure 1300 for a uniform dual wave-column, under some embodiments; and FIG. 14 illustrates an asymmetric DWC enclosure 1400 for a flared dual wave-column, under some embodiments. As can be seen in these figures, driver LS1 is located further away from the open end of column A and from the closed end of column 1 to the inside of the enclosure so that it is a different distance to the wave-column closed end and exit than the other driver LS2. The embodiment shown illustrates an asymmetrical arrangement wherein LS1 may, in one example, be placed approximately ⅕ to ¼ the length of the column from the closed end and/or exit of wave-column 1. This illustration is meant to be an example only, and any other relative placements of the two drivers relative to each other may also be used. The asymmetrical driver placement creates diverse wave-column lengths that may be effective at spreading the cone minimum frequencies for reduced cone motion, greater output, and smoother response. It may also impact the 1 wavelength cancellation frequency at approximately $4\times F_{B1}$ to smooth and extend the upper frequency bandwidth.

Figure 15:
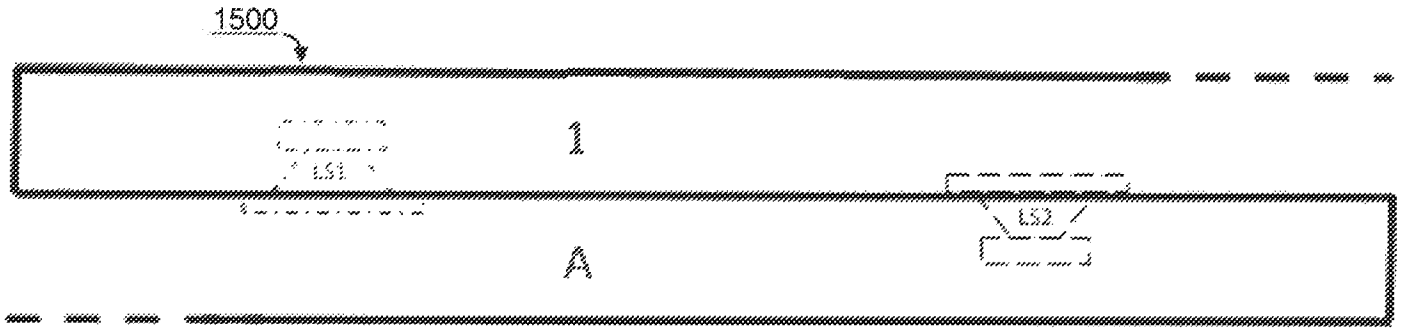
FIG. 15 illustrates a symmetric DWC enclosure for a uniform dual wave-column, under some embodiments.
Figure 16:
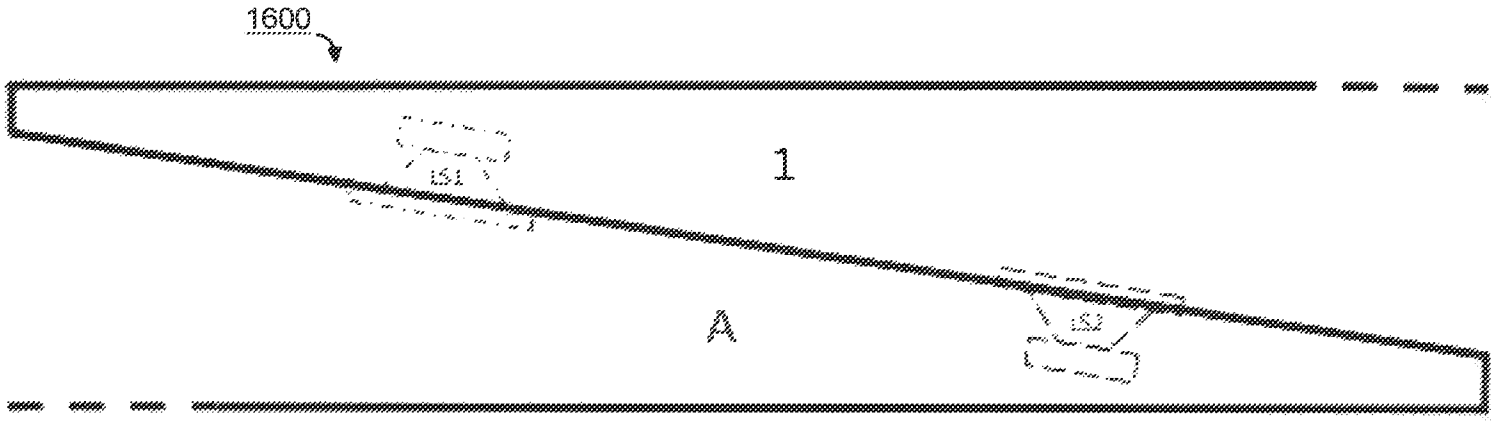
FIG. 16 illustrates a symmetric DWC enclosure for a flared dual wave-column, under some embodiments.

Besides the asymmetrical configurations of the drivers, the symmetrical arrangement may also be varied to impart different acoustic properties to the enclosure. That is, the drivers may be moved equally within the enclosure to enhance or eliminate cancellation frequencies and other effects. FIG. 15 illustrates a symmetric DWC enclosure 1500 for a uniform dual wave-column, under some embodiments; and FIG. 16 illustrates a symmetric DWC enclosure 1600 for a flared dual wave-column, under some embodiments. As compared to the configuration shown in FIG. 2, the drivers LS1 and LS2 in FIGS. 15 and 16 have been equally moved toward the inside of the enclosure. This configuration is intended to illustrate an example of a symmetrical arrangement with a driver spacing of ⅕ to ¼ wave-column length from the closed end and/or the exit. This ⅕ to ¼ length offset can be effective at eliminating the 1 wavelength cancellation frequency at approximately $4\times F_{B1}$ to smooth and extend the upper frequency bandwidth. The wave-column length/exit may be truncated at the driver edge, or optionally extend past the respective driver.

Figure 17:
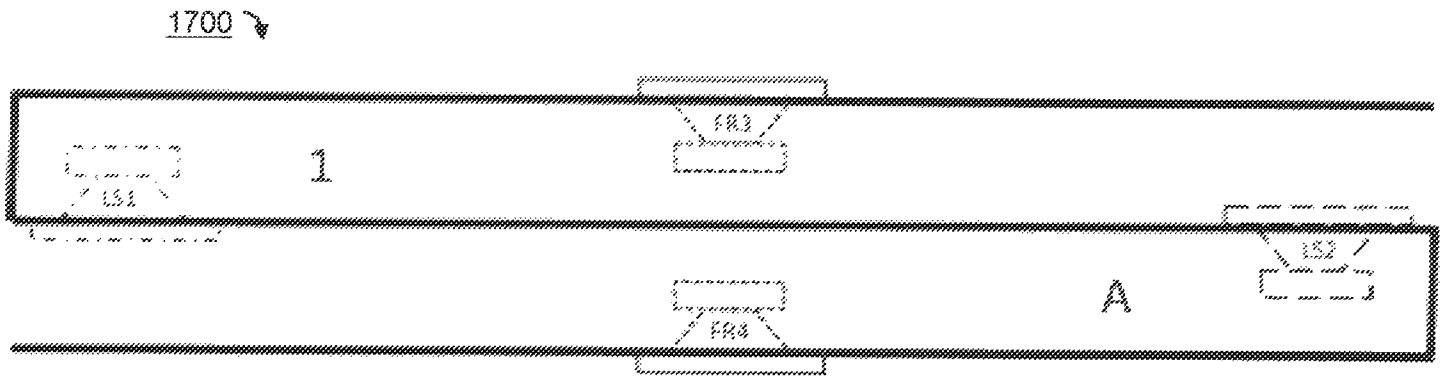
FIG. 17 illustrates a uniform DWC enclosure having additional drivers, under some embodiments.
Figure 18:
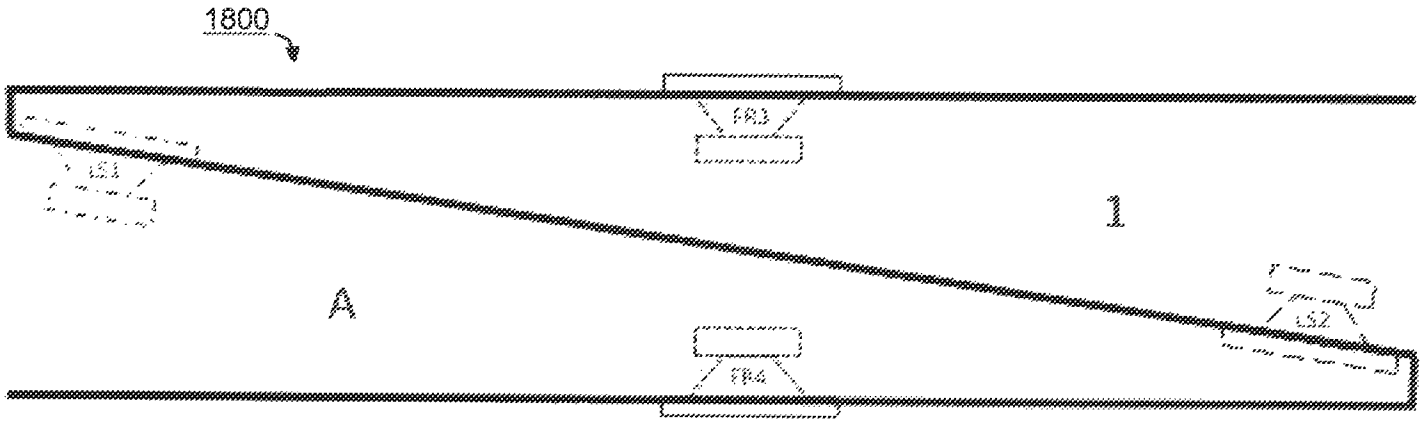
FIG. 18 illustrates a flared DWC enclosure having additional drivers, under some embodiments.

In certain embodiments, additional drivers can be used to supplement the dual LS1 and LS2 drivers. FIG. 17 illustrates a uniform DWC enclosure 1700 having additional drivers denoted FR3 and FR4, under some embodiments; and FIG. 18 illustrates a flared DWC enclosure 1800 having the additional FR3 and FR4 drivers, under some embodiments. In this embodiment, the additional drivers FR3 and FR4 are placed approximately in the middle of each wave-column, though they may be moved individually or together to different positions along their respective wave-columns.

These additional drivers produce a wide bandwidth cross-coupled wave-column enclosure as the additional drivers FR3 and FR4 extend the bandwidth of the low frequency wave-column by regeneratively coupling additional wide-band, in-phase bass energy into the wave-columns up through the 1 wavelength column frequency and further extending the upper frequency bandwidth of the system to the low-pass frequency limit of the FR3/FR4 drivers. These additional drivers may be the same type and size as the original LS1/LS2 drivers, or they may be of different sizes, such as larger (as space allows) to provide greater or different input bass energy, or smaller to provide greater upper frequency dispersion and high frequency bandwidth.

Figure 19:
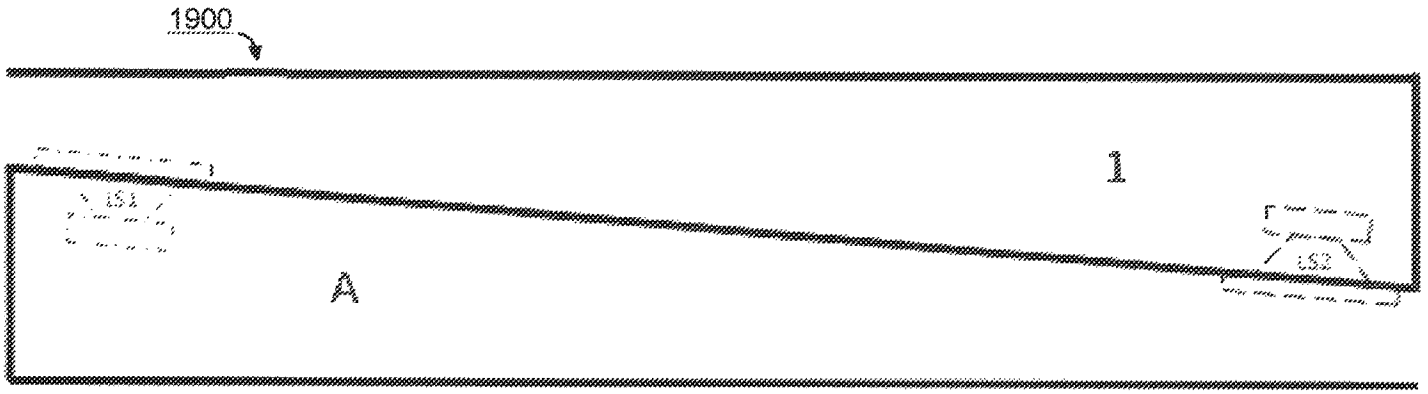
FIG. 19 illustrates a negatively flared DWC enclosure, under some embodiments.

The flared wave-column embodiments illustrated so far, such as in FIG. 7A have shown both wave-columns positively flared such that the exit is of a larger cross-sectional area than the throat of the wave-column. The positive flare shortens the effective wave-column length and may enhance the output at frequencies above $F_{B1}$ and may extend the bandwidth of the loudspeaker. In an alternative embodiment, the wave-columns may be negatively flared so that the exits are of a smaller cross-sectional area than the throat. FIG. 19 illustrates a negatively flared DWC enclosure 1900, under some embodiments. As can be seen in FIG. 19, the exit area for wave-column 1 is smaller than the area of the end closes LS2 and likewise for wave-column A. Unlike the positive flare, the negative flare lengthens the effective wave-column length and may apply a soft low-pass filter to upper range frequencies. It may be desirable to include a small positive curved flare at the exit opening to minimize acoustic turbulence and audible "chuffing" at high output levels.

Figure 20:
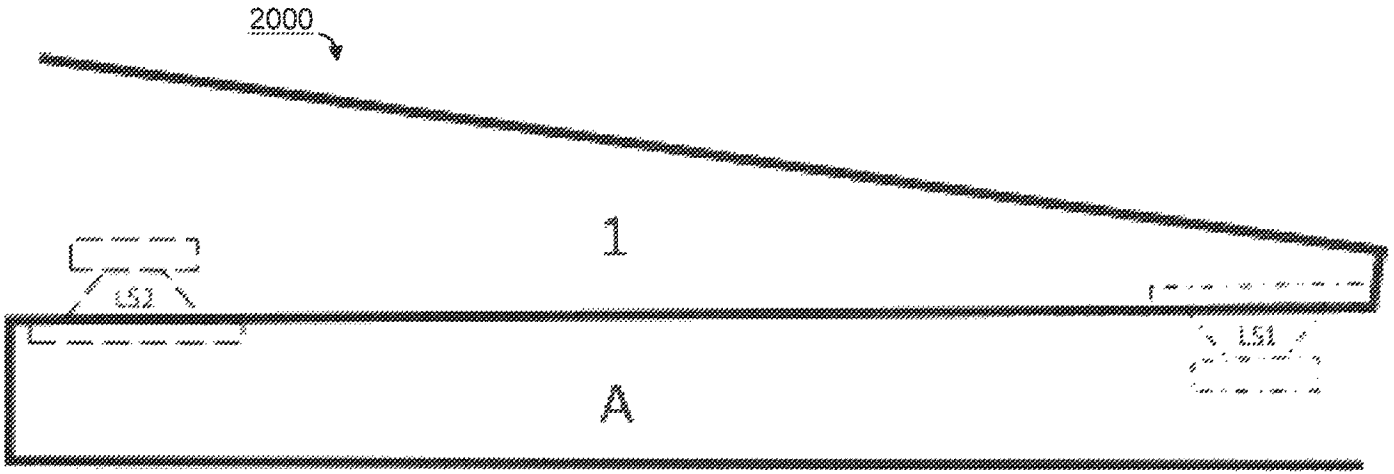
FIG. 20 illustrates an asymmetrically flared DWC enclosure, under some embodiments.

The flared wave-column embodiments illustrated so far, such as in FIG. 7A, have also shown both wave-columns flared by the same amount to produce a symmetrically flared embodiment. In an alternative embodiment, the wave-columns may be asymmetrically flared such that one wave-column is more flared than the other. FIG. 20 illustrates an asymmetrically flared DWC enclosure 2000 in which wave-column A is uniform and not flared, while wave-column 1 is positively flared. Such an embodiment may be referred to as a "hybrid flared" enclosure in which the wave-columns have different degrees of flaring. The differential flares can diversify tuning and resonances and minimize 1 wavelength cancellation and extend bandwidth. FIG. 20 illustrates only one example of a differentially flared DWC enclosure, and many other configurations are possible. For example, one wave-column may be negatively flared while the other is uniform or positively flared, the wave-columns may be flared by different amounts, and so on.

Figure 21:
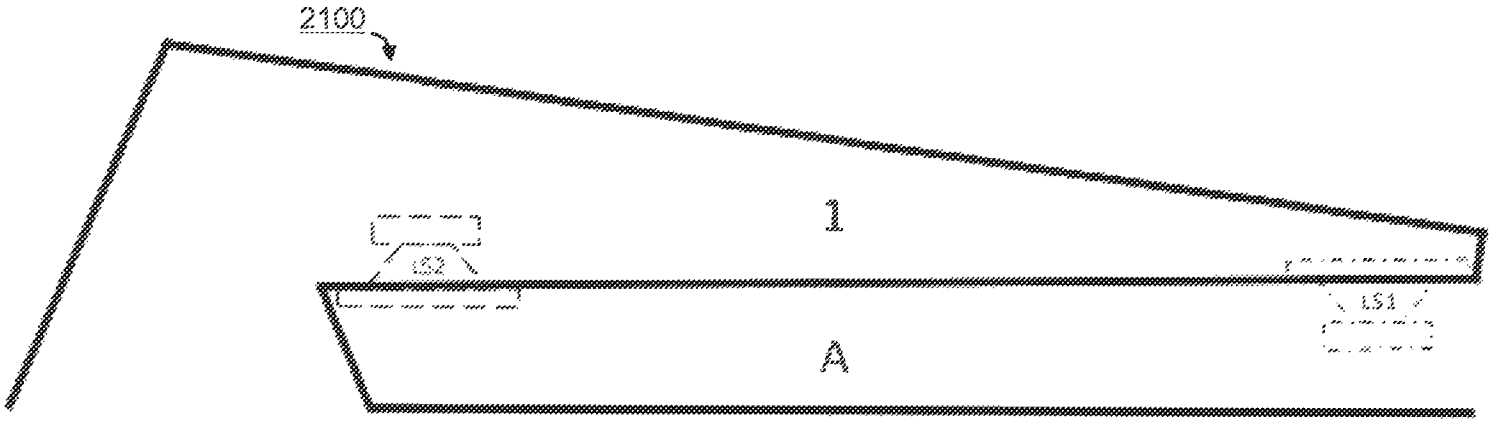
FIG. 21 illustrates an asymmetric DWC enclosure with differential wave-column lengths, under one embodiment.
Figure 22:
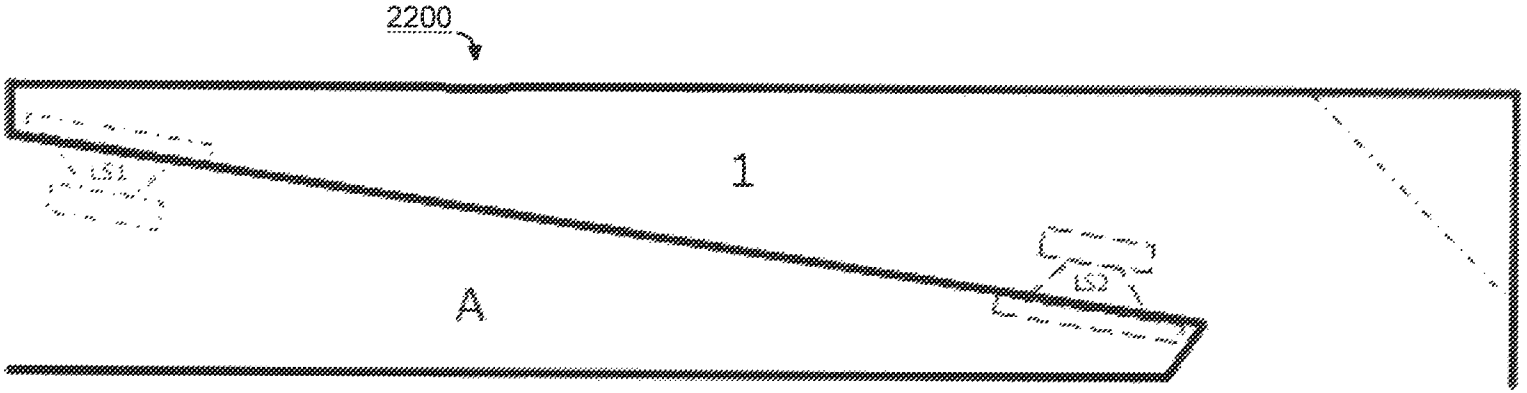
FIG. 22 illustrates an asymmetric DWC enclosure with differential wave-column lengths, under an alternative embodiment.

The wave-columns may also be asymmetrical with respect to their lengths so that one wave-column is made longer or shorter than the other wave-column. FIG. 21 illustrates an asymmetric DWC enclosure in which the wave-column lengths are different. As shown in FIG. 21, wave-column 1 is extended by adding an extender element that projects past the exit of the wave-column. This may extends the transmission length of the wave-column 1 and produces a differential wave-column length relative to the other wave-column A This differential configuration can diversify tuning and resonances and minimize 1 wavelength cancellation and extend bandwidth. The example of FIG. 21 shows wave-column 1 extended by attaching and folding an extender element to the enclosure 2100, though any other practical means to extend the wave-column may also be used, such as in FIG. 22, which shows an extender element attached to the enclosure 2200 and bent downward at a 90 degree angle.

Figure 23:
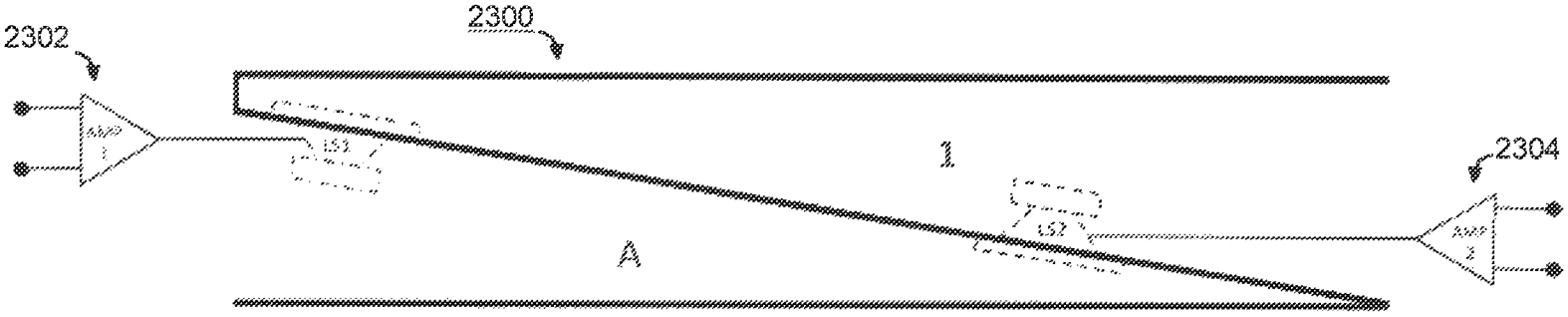
FIG. 23 illustrates a DWC enclosure in which one or more external circuits are coupled to the drivers, under some embodiments.

External circuits, such as amplifiers and filters may also be used to change the relevant characteristics of the DWC enclosure. FIG. 23 illustrates a DWC enclosure 2300 in which one or more amplifiers are coupled to the drivers to alter the operating characteristics of the enclosure. For this embodiment, amplifier 2302 (AMP1) is coupled to driver LS1 and amplifier 2304 (AMP2) is coupled to driver LS2. The amplifiers can drive their respective drivers at different levels and phases so that any phase/amplitude drive difference between the two amps can be used to optimize the summation for extended bandwidth and/or greater output over the operating range of the system. Other circuitry, such as filters, crossovers, and the like may also be used.

Figure 24:
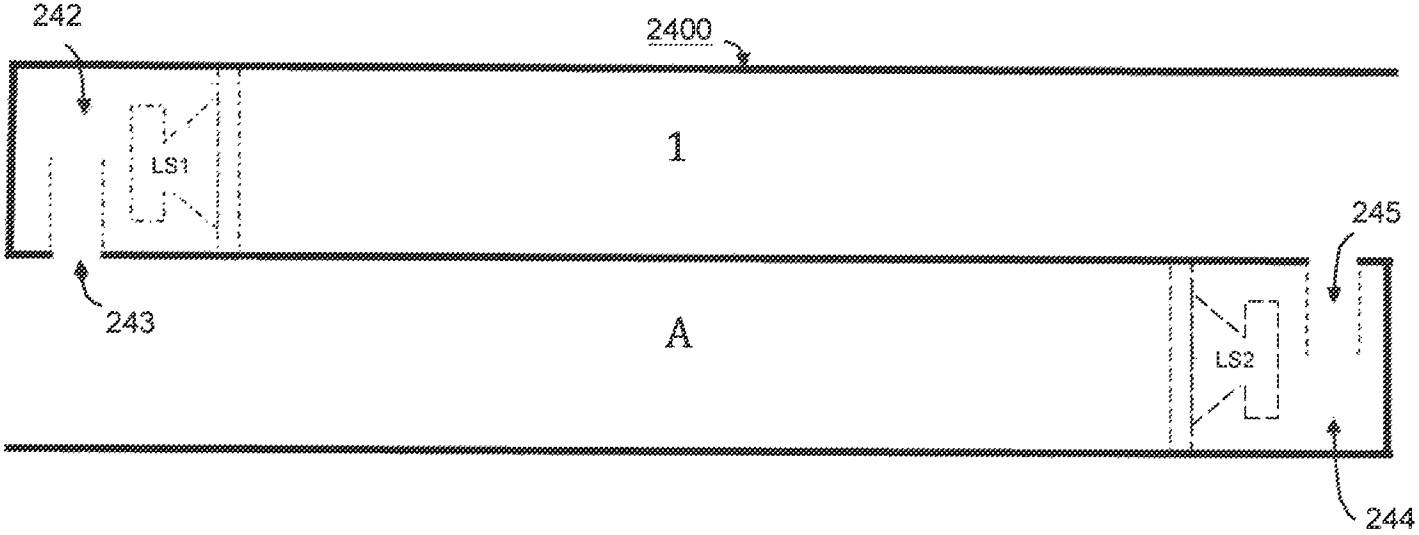
FIG. 24 illustrates a DWC enclosure incorporating vented Helmholtz-tuned rear chambers, under an embodiment.

In certain embodiments, other mechanisms that affect the relevant DWC enclosure characteristics can also be incorporated into the design. One such mechanism is a Helmholtz resonator that utilizes air resonance within the cavities defined by the wave-columns. FIG. 24 illustrates a DWC enclosure incorporating vented Helmholtz-tuned rear chambers, under some embodiments. For the embodiment of FIG. 24, a uniform DWC enclosure 2400 has two equal length wave-columns 1 and A. The drivers LS1 and LS2 are sized or baffled and placed such that they seal within their respective wave-columns to form a sealed-off, vented chamber with their back surface. Thus, for the example of DWC enclosure 2400, LS1 forms a rear chamber 242 and LS2 forms rear chamber 244. The chambers are vented by vents 243 and 245, and the vent size and driver positions, as well as the enclosure shape and size can be used to tune the chambers 242 and 244 to different frequencies to affect the sound output as desired. For example, the chambers may be tuned to the 1 wave-column frequency, and can eliminate the cancellation at approximately $4\times F_{B1}$ and create a low-pass filter for interference frequencies above the $4\times F_{B1}$ frequency. The Helmholtz chamber of FIG. 24 can also be used in a flared or hybrid-flared DWC enclosure 2500, as shown in FIG. 25, in which wave-columns are both positively flared and the Helmholtz chambers 252 and 254 with respective vents 253 and 255 are formed to the rear of the drivers LS1 and LS2, as shown.

Figure 25:
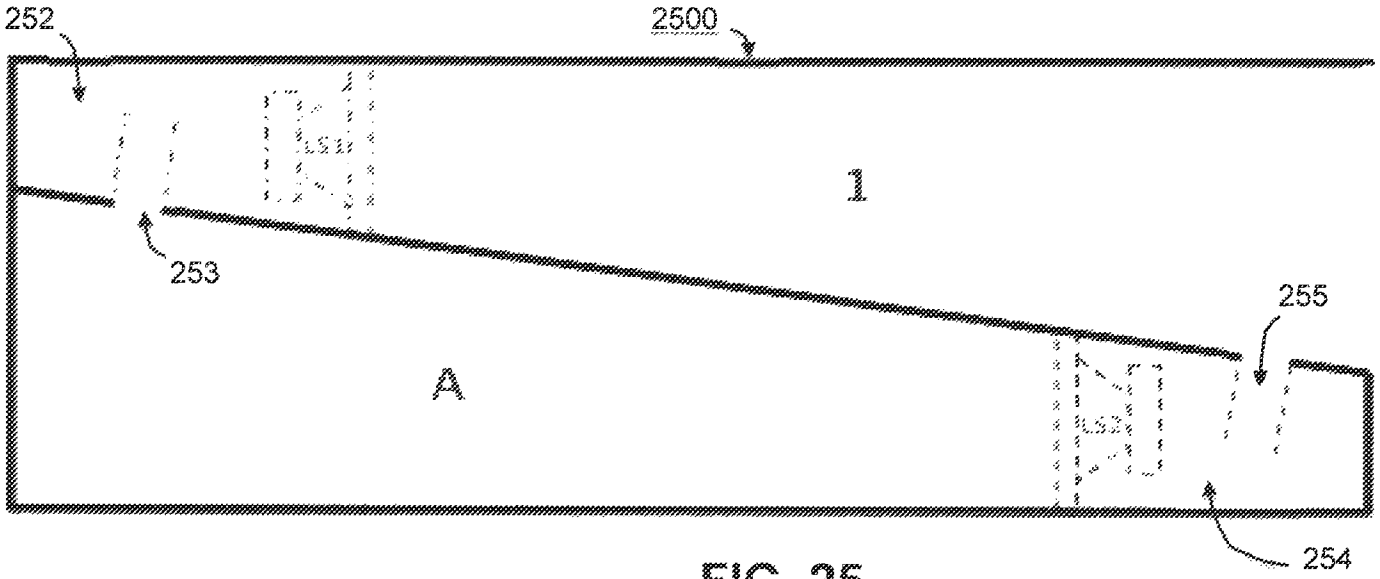
FIG. 25 illustrates a flared DWC enclosure incorporating vented Helmholtz-tuned rear chambers, under an alternative embodiment.
Figure 26:
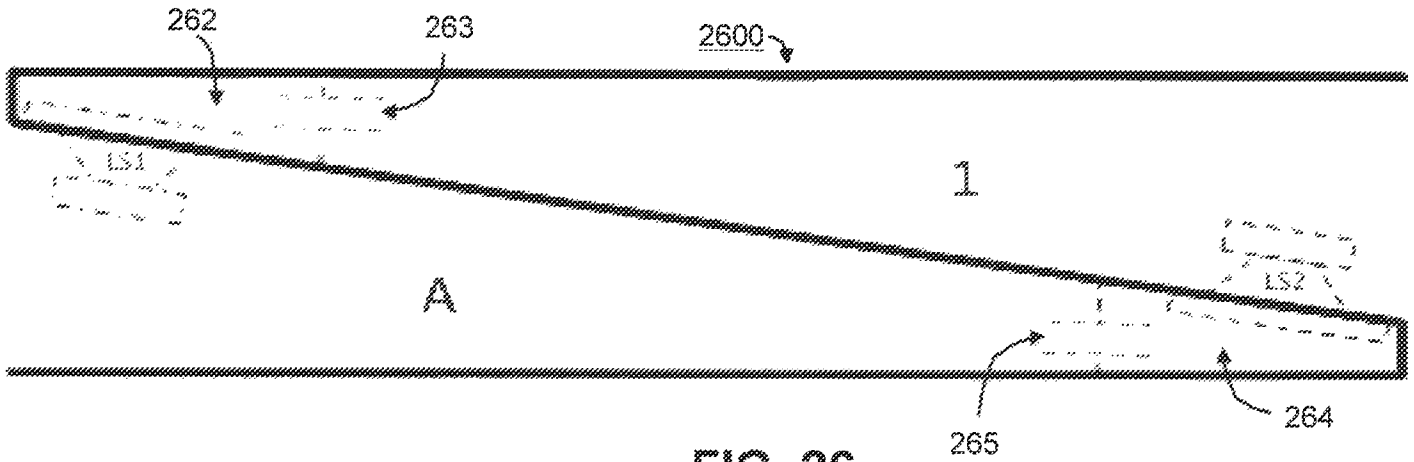
FIG. 26 illustrates a flared DWC enclosure incorporating vented Helmholtz-tuned front chambers under a further alternative embodiment.

FIGS. 24 and 25 illustrate embodiments in which the DWC enclosures incorporate rear Helmholtz chambers. In an alternative embodiment, the Helmholtz chambers may be vented in front of the drivers. FIG. 26 illustrates a DWC enclosure 2600 having vented Helmholtz-tuned front chambers under this embodiment. For the example of DWC enclosure 2600, driver LS1 is placed in a chamber 262 that is formed with a baffle or wall that has a vent 263 that vents the chamber to the wave-column 1. Likewise, driver LS2 is placed in a chamber 264 that is formed with a baffle that has a vent 265 that vents the chamber to wave-column A. The vent sizes, driver positions, and the enclosure shape and size can be used to tune the chambers 262 and 264. Thus, the Helmholtz chamber can be applied to the front or back wave of the drivers and can be used in the uniform or positive flared versions of the wave-columns.

Figure 27:
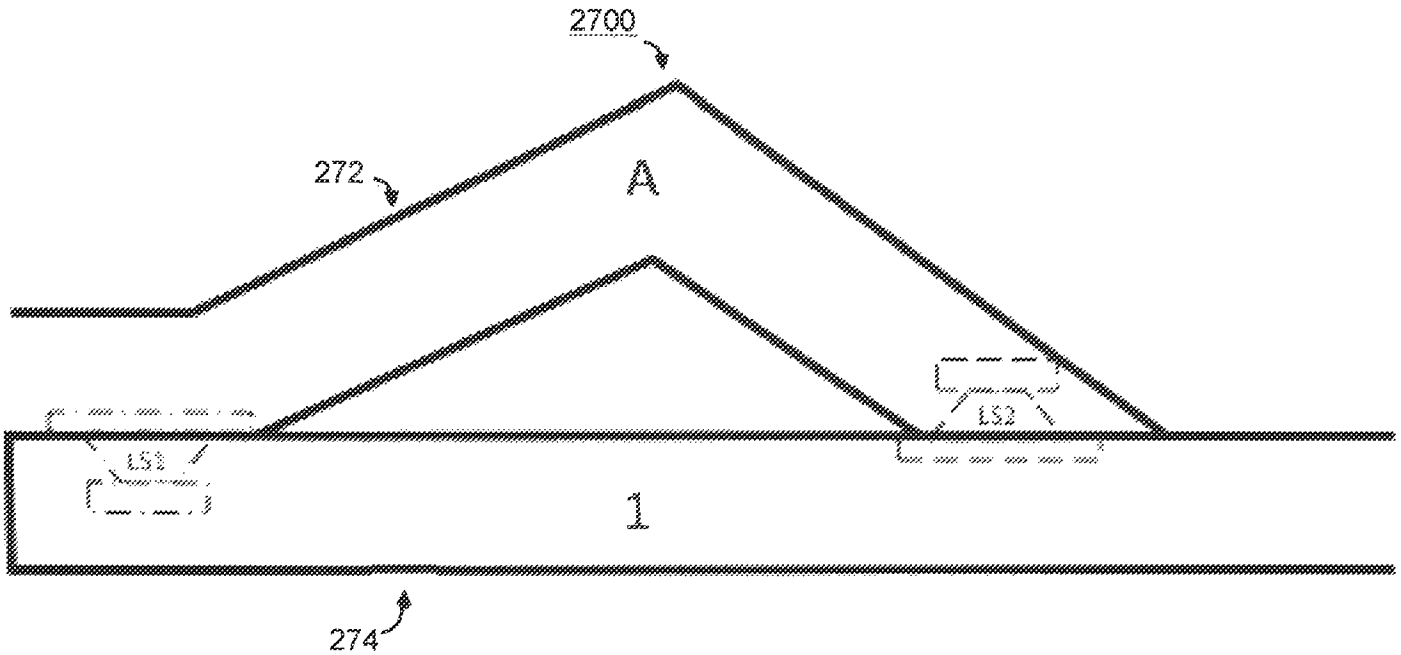
FIG. 27 illustrates a DWC enclosure featuring differential driver spacing, under some embodiments.

In an embodiment, the wave-columns may be formed by joining two differently configured wave-guide structures to create differential driver spacings based on geometry. FIG. 27 illustrates a DWC enclosure featuring differential driver spacing under an embodiment. As shown in FIG. 27, enclosure 2700 has a first waveguide element 272 that forms the wave-column A, and a second waveguide element 274 that forms wave-column 1. The two elements are configured such that they have equal column lengths but the bend in wave-column A produces a differential spacing of driver LS2 relative to driver LS1 with respect to the exits of the wave-columns. In this embodiment, due to the decoupling between the primary and regenerative diaphragm surfaces, the differential spacing between the primary and regenerative woofer diaphragms can be used to create a broader range of frequencies that are supported by the regenerative effect. This can be particularly useful to minimize cone excursion just above $F_{B1}$, and also to diversify any cancellation interference at the 1 wavelength frequency, increasing maximum output, smoothing and extended over all response. Optional differential amplifier drive can be provided to the drivers to further this optimization (not shown). FIG. 27 is intended to illustrate one example of a differential driver spacing embodiments, and many different configurations are possible depending on the shape, length, and configuration of the two waveguide elements. Furthermore, the length of the two wave-columns may be made unequal and/or flared or hybrid-flared to further produce different characteristics.

Figure 28B:
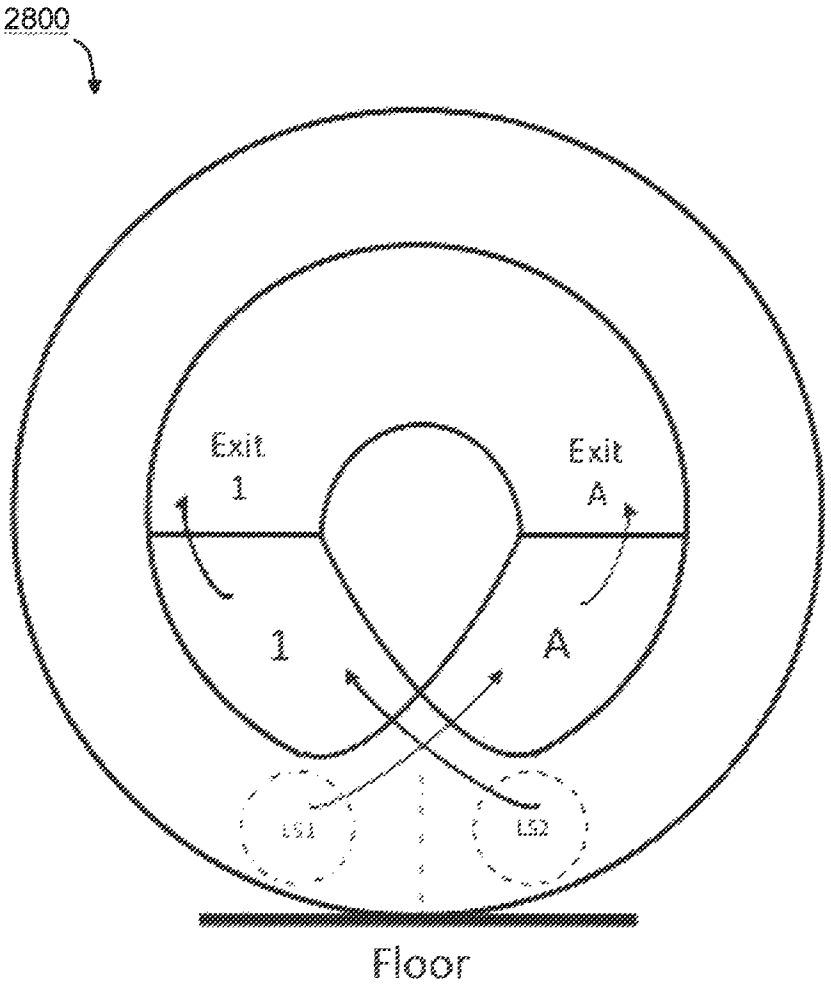
FIG. 28B is a side view of the circular DWC enclosure of FIG. 28A.
Figure 28A:
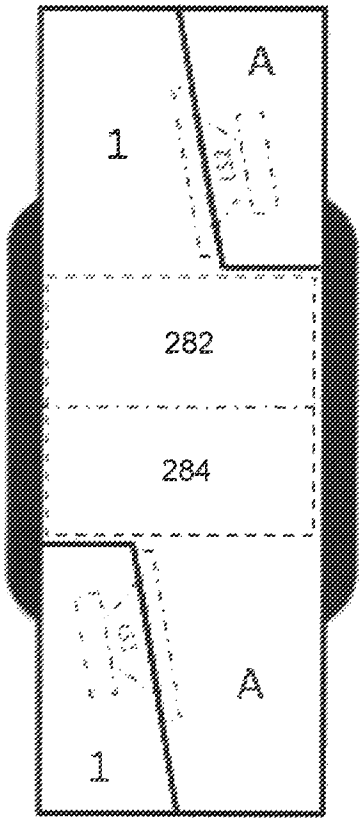
FIG. 28A illustrates a top view of a circular DWC enclosure under some embodiments.

As shown in FIG. 12, the enclosure may be formed into a curved structure to help smooth the wave-columns and allow for flexible projection of the two drivers, such as in the same direction. This configuration can be extended to create a circular DWC enclosure. FIGS. 28A and 28B illustrate a circular DWC enclosure under some embodiments. FIG. 28A illustrates a top view of a circular DWC enclosure 2800, and FIG. 28B is a side-view of this enclosure. As can be seen in FIG. 28A, the enclosure comprises a tubular structure (round or square cross-section) that is wrapped around a center area with the two wave-columns 1 and A formed by a baffle within the structure. For the example embodiment shown, the drivers LS1 and LS2 are mounted so that they project in a front-back arrangement, though the enclosure can be configured in an over-under arrangement as well. The side view of FIG. 28B shows the acoustic flow for this enclosure in which the front of driver LS1 radiates up wave-column 1 around the loop structure, past the back of driver LS2 and exits wave-column 1 through rectangular exit 282. The front of driver LS2 radiates up wave-column A, around the loop structure, past the back of driver LS1, and exits wave-column A through rectangular mouth opening 284. The circular embodiment illustrated in the example of FIGS. 28A and 28B may be appropriate loop shape other than circular, such as oval, square, rectangular, and so on.

Embodiments of the DWC enclosure described herein may be used in loudspeaker systems that are deployed in any number of different audio playback environments, including but not limited to: theatres, auditoriums, homes, offices, performance halls, listening booths, and so on. Any type of appropriate audio content (e.g., music, dialog, special effects, ambient sound, etc.) may be played through the loudspeaker enclosure, and the configuration and size of the enclosure and drivers may be selected accordingly. Although embodiments have been described with respect to low frequency sound applications, embodiments are not so limited and the enclosure may be configured to operate and provide the desired effect with any appropriate frequency range. However, certain linear enclosure embodiments are generally more effective when applied to subwoofer or low-frequency effect bandpass ranges, such as from 20 Hz to 100 Hz.

Figure 29A:
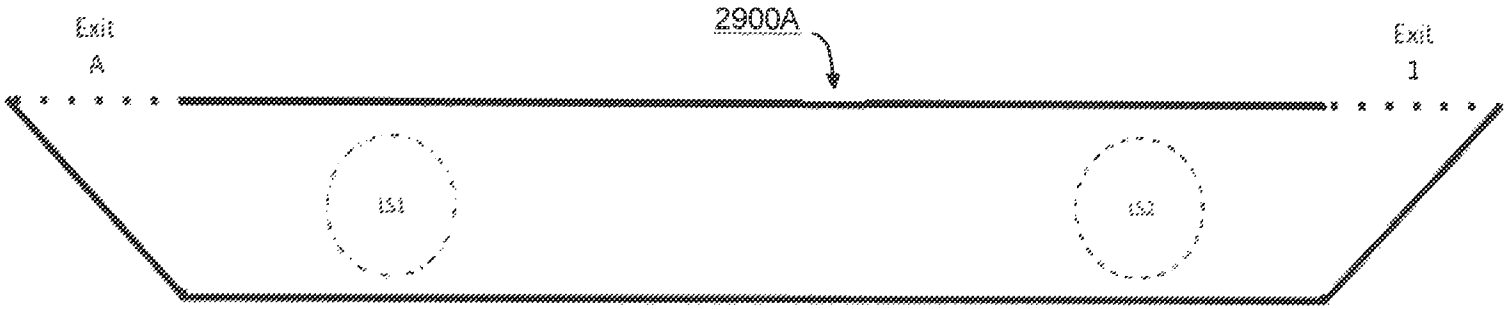
FIG. 29A illustrates a top view of a mounting structure for a DWC enclosure, under some embodiments.
Figure 29B:
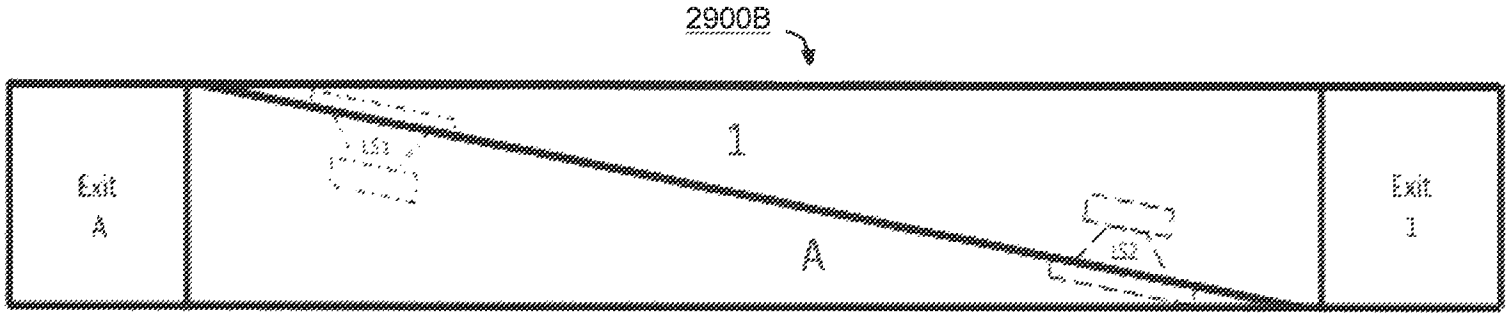
FIG. 29B is a front view of the mounting structure of FIG. 29A.

For practical installations and applications, the enclosure may be configured to be mounted through in-floor, in-ceiling, or in-wall loudspeaker mounting systems. FIGS. 29A and 29B illustrate a possible mounting structure for a DWC enclosure, under some embodiments. FIG. 29A shows a top view 2900A of an enclosure for use in a floor, ceiling, or wall mount application, and FIG. 29B shows a front view 2900B of the enclosure. The enclosure of FIGS. 29A and 29B features a positive flare configuration with smooth transition 90 degree rotation of the exits of the wave-columns for a single direction of sound direction, and can be used for in-floor, in-ceiling, in-wall, or similar behind surface placement. FIGS. 29A and 29B are intended to be for example only, and any appropriate enclosure and mounting system can be used depending on the configuration of the wave-columns, drivers, and mounting systems, as well as the requirements and constraints of the listening environment. The drivers may be installed or positioned so that they fire in the same direction, as shown in FIG. 29B, or in opposite directions (e.g., for very low frequency applications), or they may be angled to project sound away or toward each other.

Multiple Driver Embodiments

Figure 30:
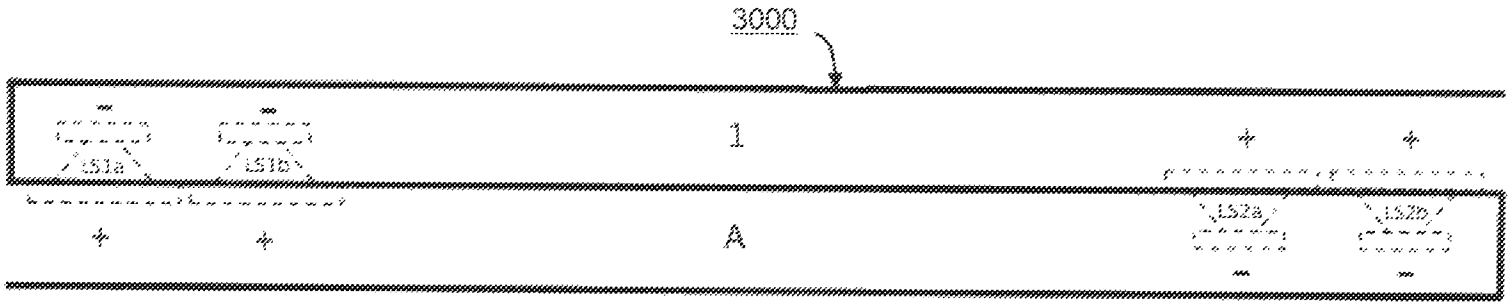
FIG. 30 shows a multi-driver DWC enclosure under one embodiment.
Figure 31:
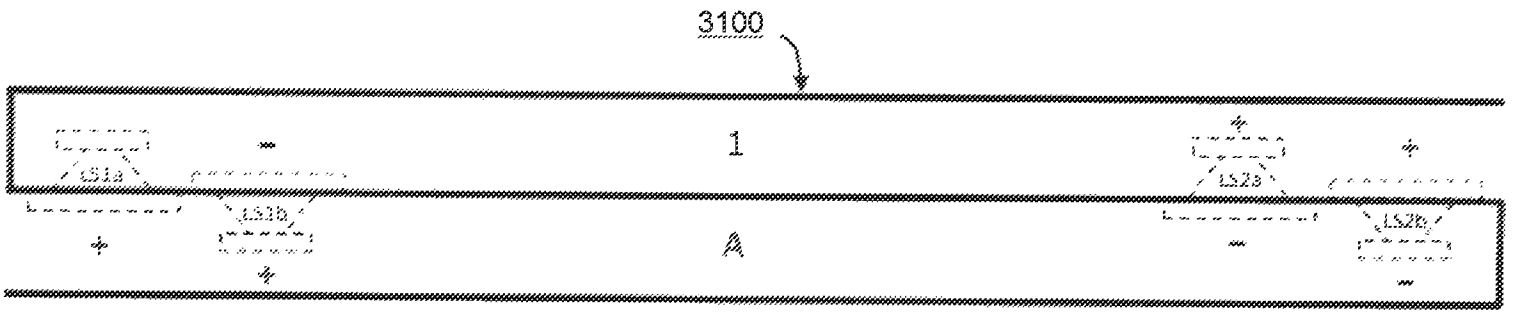
FIG. 31 shows a multi-driver DWC enclosure under an alternative embodiment.

The embodiments described above generally illustrated a single speaker projecting sound into each end of a wave-column. In an alternative embodiment, a speaker array of at least two speakers may be used at each end of a wave column. FIG. 30 illustrates a multi-driver DWC or driver array DWC enclosure 3000 under one embodiment. In this embodiment, two loudspeaker transducer assemblies with each active loudspeaker transducer assembly including at least one transducer are located in each end portion of a wave-column. Thus, as shown in FIG. 30, speakers LS1*a* and LS1*b* project sound from a front surface into wave-column A, while speakers LS2*a* and LS2*b* project sound from a front surface into wave-column 1. FIG. 30 illustrates an embodiment in which each loudspeaker transducer assembly includes transducers oriented with a common acoustical polarity radiating into each wave column. Other variations are also possible, such as with respect to number of speakers per array, distance between speakers, speaker size, and so on. One alternative embodiment is to alter the speaker electrical connection polarity and physical arrangement polarity in each array, and FIG. 31 illustrates such an embodiment. As shown in FIG. 31 for enclosure 3100, speaker pairs LS1 and LS2 are each configured in a push-pull configuration such that their speakers are oriented with opposite polarities. This configuration generally reduces even-order distortion.

Multiple-Fold Embodiment

Embodiments of the DWC enclosure may include one or more folds to provide different sound exit configurations and provide smaller overall dimensions, as well as augment certain filtering properties and other audio effects. Although certain embodiments described thus far feature a single fold, e.g., FIGS. 11 and 12, in a general single fold system, the expansion rate of the wave-columns is either zero (e.g., not expanding) like that of a straight pipe, or expanding on only one dimension (e.g., parabolic expansion) like that of a uniformly increasing horn. In an embodiment, the DWC enclosure can be configured to have multiple folds in which the expansion rate can be non-uniform or arbitrary, such as conical, parabolic or any combination of different voluminous shapes. This type of configuration alters the acoustic response of the speaker depending on the shape and size parameters, and can make the cabinet smaller for a desired column or horn length, especially in the case of a conical design.

Figure 32A:
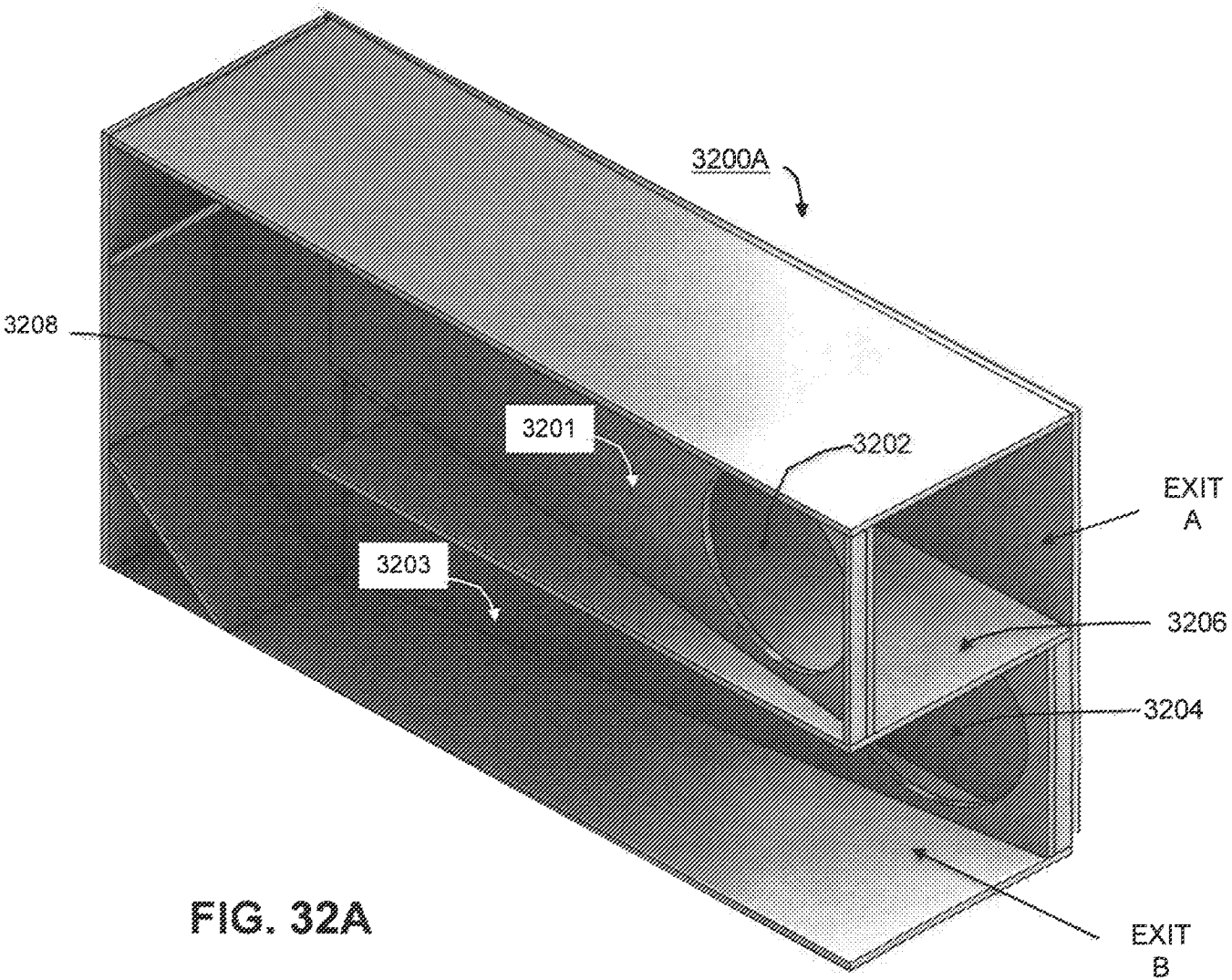
FIG. 32A and FIG. 32B illustrate a multiple-fold DWC enclosure according to an embodiment.
Figure 32B:
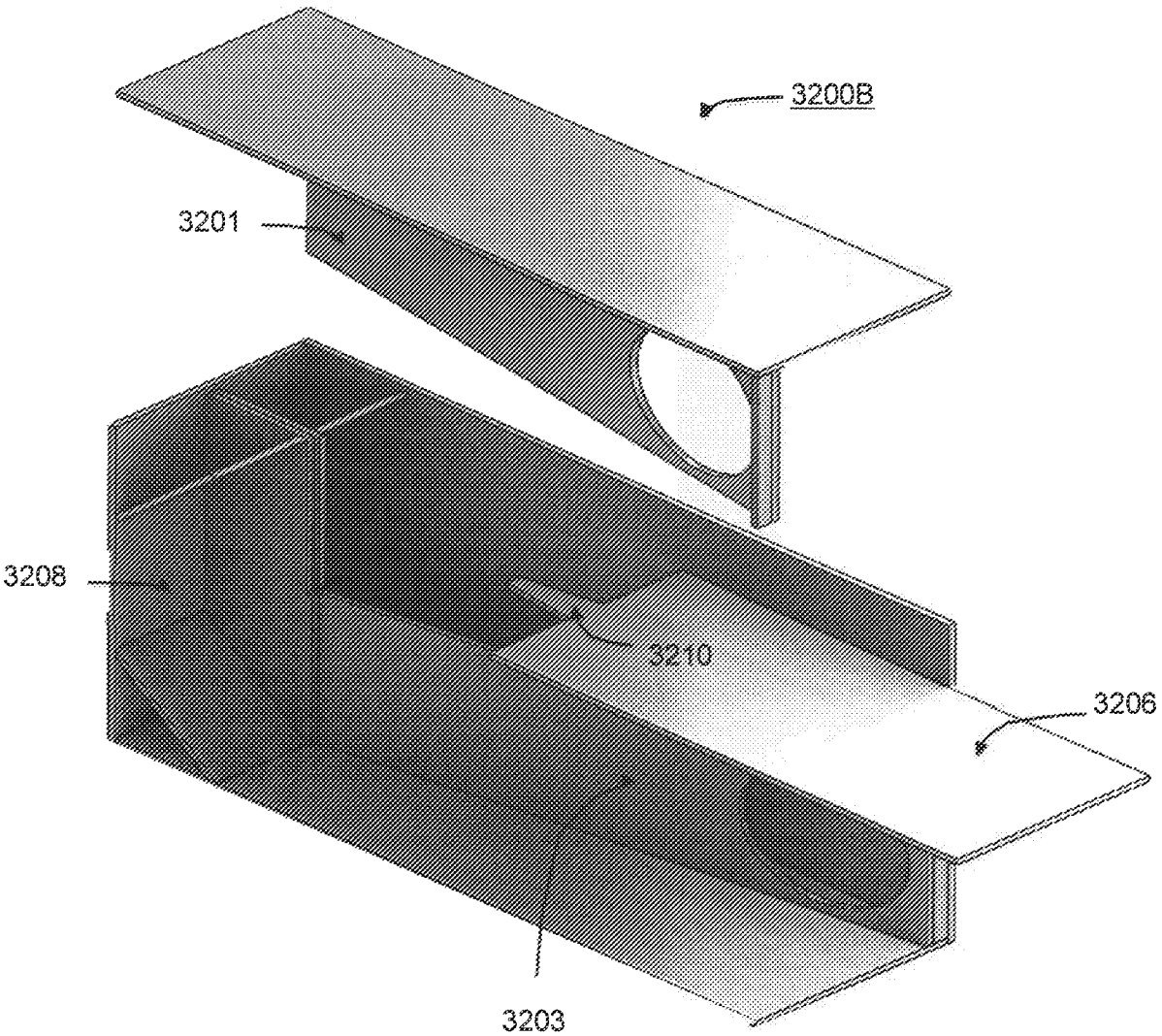

FIG. 32A illustrates a multiple-fold DWC enclosure according to an embodiment. The picture of FIG. 32A shows one side wall removed to show a cross-section of the interior of the enclosure 3200A. The side wall of the cabinet has been removed for purposes of illustration only. Enclosure 3200A forms an enclosed volume that is separated by internal partitions into two wave-columns formed by angled partitions 3201 and 3203 and separated by partition 3206. The two angled partitions are joined together by junction 3208, which includes a joint that couples the partitions together at the prescribed angle. FIG. 32B shows an exploded view 3200B of the DWC enclosure of FIG. 32A to illustrate the composition of junction 3208, which couples the angled partitions 3201 and 3203 through an angle formed in the junction. As in FIG. 32A, here the side wall of the cabinet is not shown, so the insides can better be viewed. A notch 3210 in the separating partition 3206 fits into this angle and shows the amount of slant provided by the junction. This angle can be increased or decreased depending on the desired size, shape and configuration of the enclosure.

With reference to FIG. 32A, each partition 3201 and 3203 includes a cutout, 3202 and 3204, for a driver to be mounted. The drivers can be mounted in any appropriate polarity, and can be an array of two or more speakers, as described above. The internal partitions are arranged so that the exits (Exit A and Exit B) for each wave column exit out of the same end of the enclosure. This is distinct from the embodiments shown in FIGS. 11 and 12 in which the exits project in the same direction, but are separated by a certain distance (such as on the order of several inches or even feet). For the embodiment of FIG. 32A, the exits are substantially adjacent to each other in that they are effectively separated only by the thickness of partition 3206, which can be varied to create different close separation distances. A driver is installed in cutout 3204 close to a closed far end of a wave-column such that sound projected out of a front side of the driver is routed up in the enclosure to project out of Exit A, which is placed close to the back side of driver at cutout 3202. Likewise, a driver in installed at cutout 3202 close to a closed far end of a wave-column such that sound projected out of a front side of the driver is routed up in the enclosure to project out of Exit B, which is placed close to the back side of driver at cutout 3204.

Figure 33:
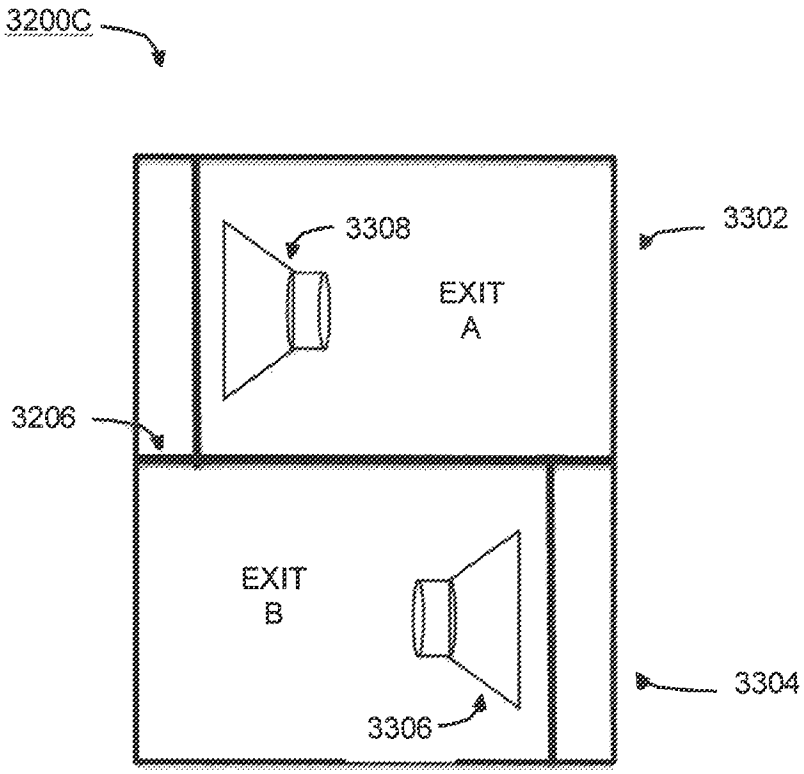
FIG. 33 shows an end view of the DWC enclosure of FIG. 32 in an example vertical orientation.

Partition 3206 divides the enclosure into two sections. Depending on the orientation of the enclosure, the partition could divide the enclosure into two vertical sections, denoted upper section, and lower section, as shown; or it could divide the enclosure into two side-by-side sections that may be denoted left section and right section. FIG. 33 shows an end view 3200C of the DWC enclosure of FIG. 32 in an example vertical orientation. Enclosure 3200 is divided into an upper section 3302 and a lower section 3304 by partition 3206 with respective drivers 3306 and 3308 oriented at a polarity that projects directly into a far end of the corresponding wave-guides.

Figure 34A:
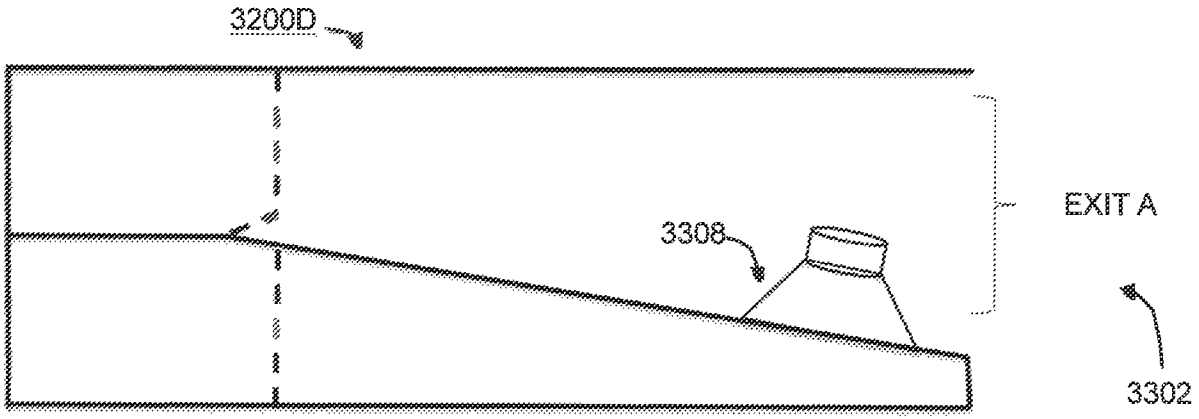
FIG. 34A shows a top view cross-section of an upper section of the DWC enclosure of FIG. 32.
Figure 34B:
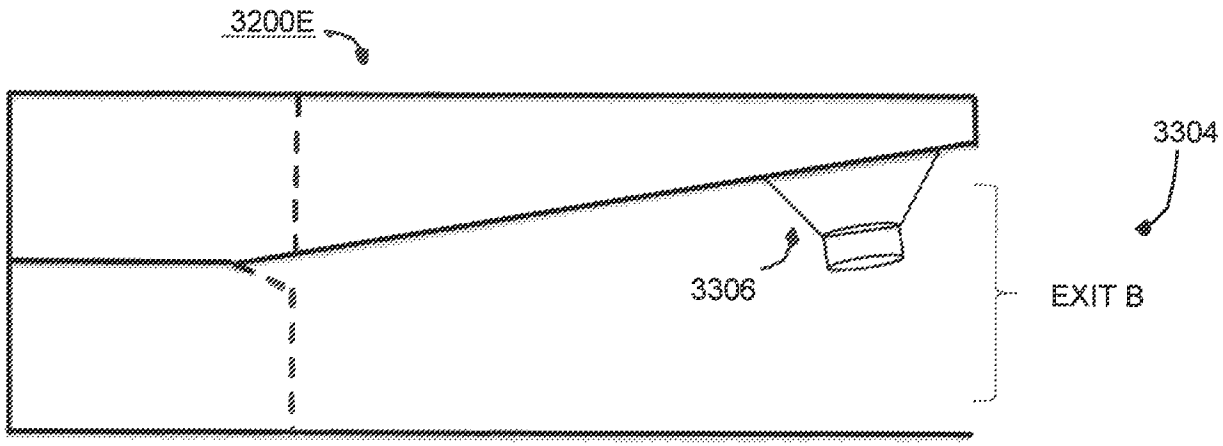
FIG. 34B shows a top view cross-section of a lower section of the DWC enclosure of FIG. 32.

FIG. 34A shows a top view cross-section 3200D of an upper section 3302 of the DWC enclosure of FIG. 32; and FIG. 34B shows a top view cross-section 3200E of a lower section 3304 of the DWC enclosure of FIG. 32. These views illustrate the location of Exits A and B relative to the placement of drivers 3202 and 3204.

Figure 35A:
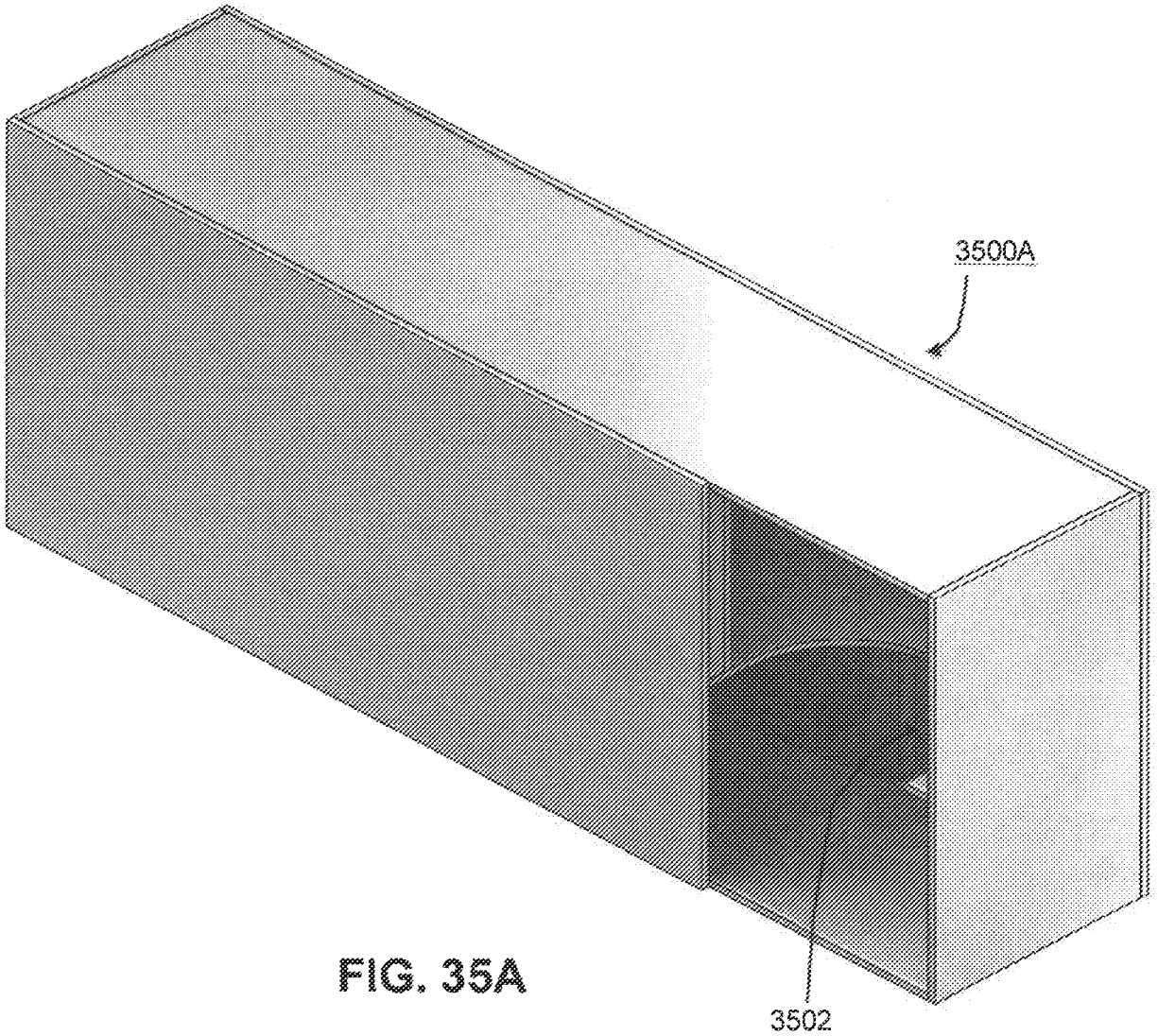
FIG. 35A illustrates a multiple fold DWC enclosure that has an additional 90 degree turn at an end of the enclosure, under an embodiment.
Figure 35B:
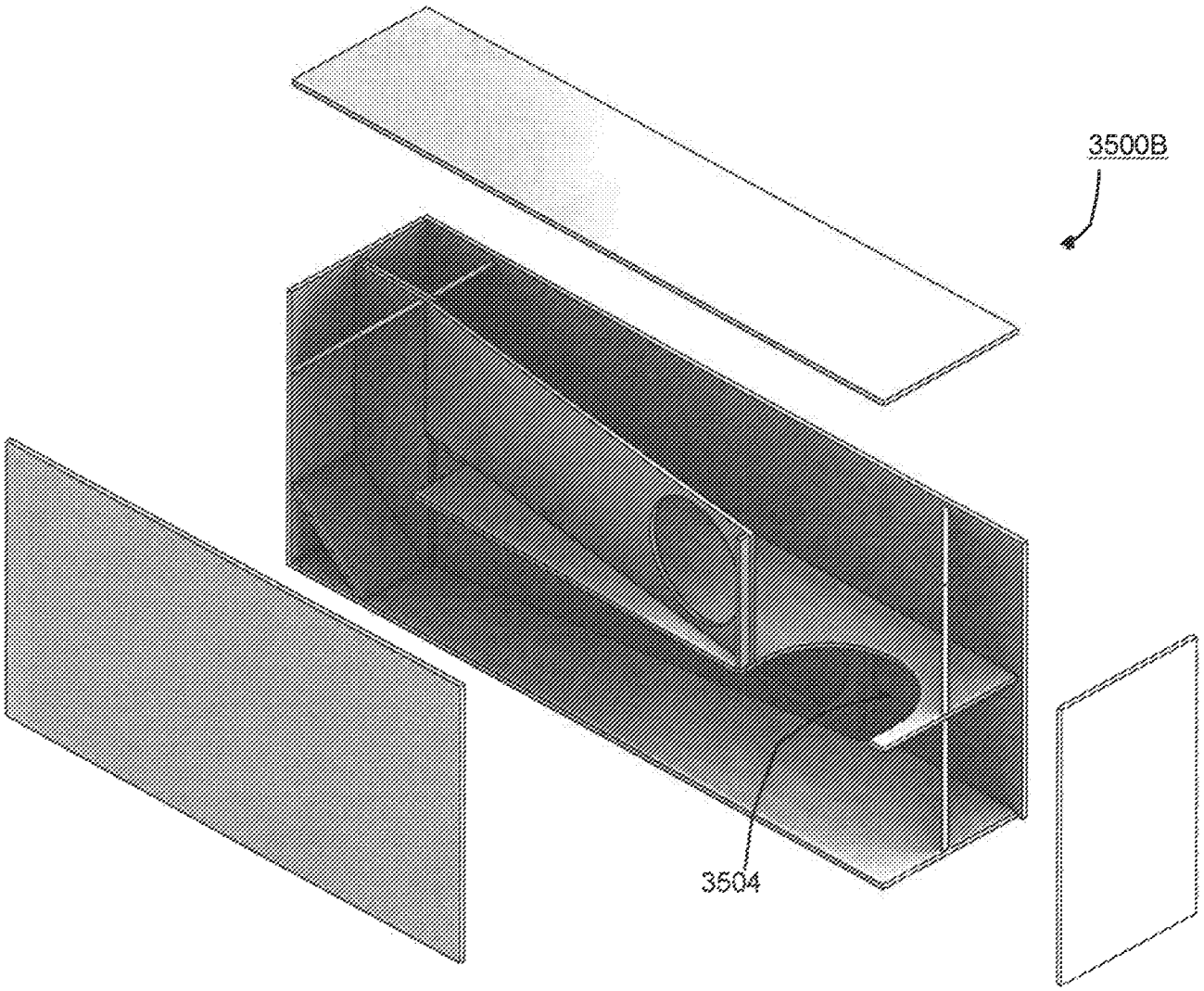
FIG. 35B is a cutaway drawing of the DWC enclosure of FIG. 35A.

The multiple fold DWC enclosure shown in FIGS. 32-34 has a fold that brings the exits A and B together to one end of the enclosure. Additional folds can be added to further reduce space requirements and/or alter the acoustic character of the enclosure. FIG. 35A illustrates an enclosure that has an additional 90 degree turn at an end of the enclosure. As shown in the cutaway view 3500A of the enclosure, a hole cut into the partition separating the two sections provides an additional fold or turn 3502 at one end of the enclosure. FIG. 35B is an exploded view of the DWC enclosure of FIG. 35A. The cutaway section 3504 serves to provide easy access to install the drivers.

Figure 36A:
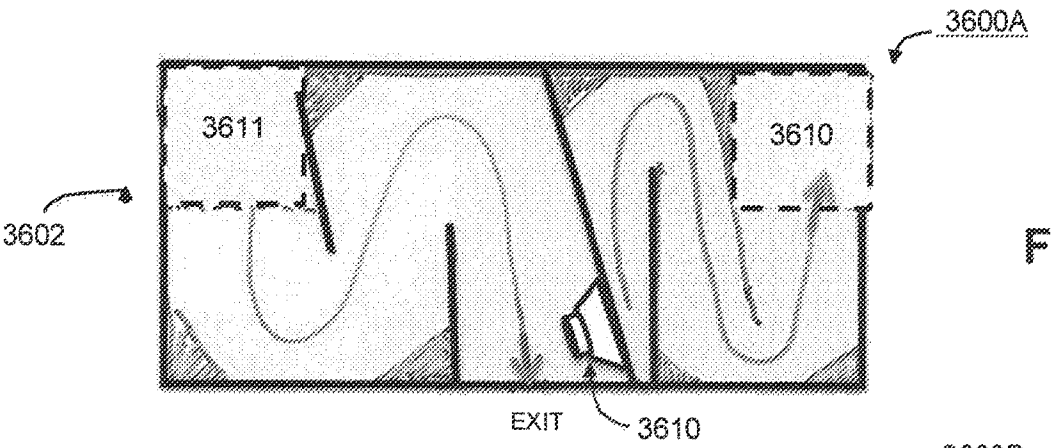
FIG. 36A illustrates a top view cross-section of a multiple fold DWC enclosure with a side exit for an upper section, under an embodiment.
Figure 36B:
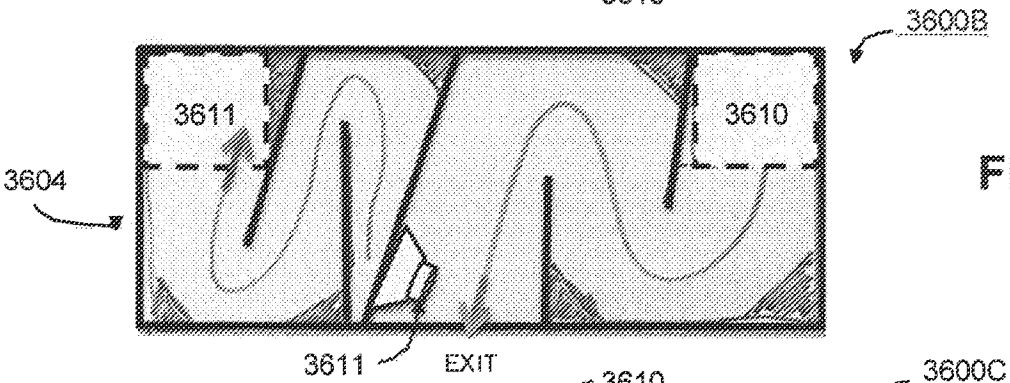
FIG. 36B illustrates a top view cross-section of a multiple fold DWC enclosure with a side exit for a lower section, under an embodiment.
Figure 36C:
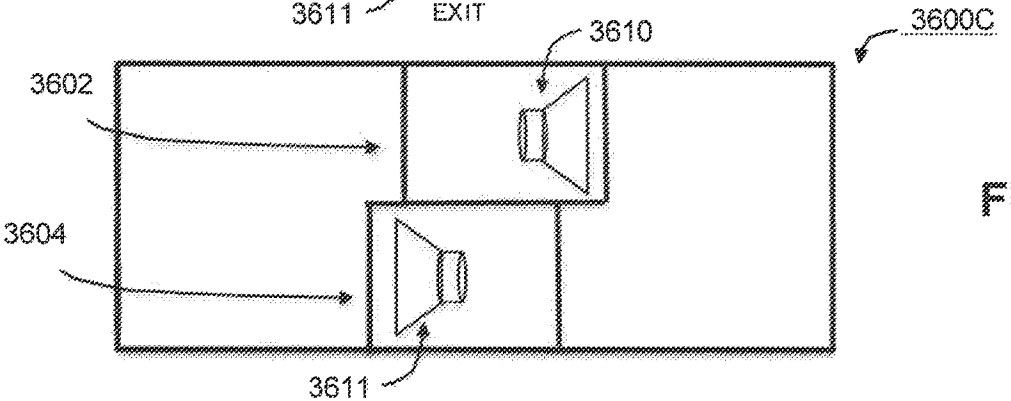
FIG. 36C shows a side view of the enclosure of FIGS. 36A and 36B, under an embodiment.

Embodiments of the multiple fold DWC enclosure are directed to having the exit holes located at an end of the enclosure. However, the folds may be configured to allow the exit holes to be located at any surface of the enclosure, such as out of the sides or top/bottom of the enclosure. FIG. 36A illustrates a top view cross-section 3600A of a multiple fold DWC enclosure with a side exit for an upper section 3602, under an embodiment, and FIG. 36B illustrates a top view cross-section 3600B of a multiple fold DWC enclosure with a side exit for a lower section 3604, under an embodiment. FIG. 36C shows a side view 3600C of the enclosure of FIGS. 36A and 36B, under an embodiment. Cutaways or holes, 3610 and 3611, provide an acoustic path between the upper and lower sections for sound transmission from drivers 3610 and 3611.

The multi-folded embodiments use a plurality of folds/bends, in any direction or axis, to bring the exits together, and provides an enclosure that can feature multi-dimensional or arbitrary expansion rates to tailor the acoustic response of the loudspeaker in a space efficient enclosure.

Example Implementations

As described herein, the DWC enclosure is highly versatile with respect to configuration options. Although specific configuration parameters and characteristics are dependent on actual implementation and deployment considerations (e.g., venue size/shape, audio content, power, etc.), certain system configurations are provided as follows to give some example of possible system configurations.

Example 1, large-scale commercial theater venue: Enclosure length: 11.3 feet (3.44 meters); Enclosure height× width: 17.5"×15" (44.5 cm×38.1 cm); Woofers: 15 inch; X-max: 9.5; Bandwidth: 25 Hz to ~100 Hz+/−[3 dB; Sensitivity: 106 dB 2.83 v @ 1 meter; and Maximum output: 136 dB @ 25 Hz.

Example 2, domestic home theatre venue: Enclosure length: 11.3 feet (3.44 meters); Enclosure height×width: 8"×7.25" (20.3 cm×18.4 cm); Woofers: 7 inch; X-max: 9.5; Bandwidth: 25 Hz to ~100 Hz+/−L3 dB; Sensitivity: 95 dB 2.83 v @ 1 meter; and Maximum output: 123 dB @ 25 Hz.

Example 3, alternate domestic home theatre venue: Enclosure length: 8.8 feet (2.7 meters); Enclosure height× width: 8"×7.25" (20.3 cm×18.4 cm); Woofers: 7 inch; X-max: 9.5; Bandwidth: 32 Hz to ~125 Hz+/−3 dB; Sensitivity: 95 dB 2.83 v @ 1 meter; and Maximum output: 126 dB @ 32 Hz.

The above are intended to be examples only and many other configurations are possible. With respect to certain design parameters, certain guidelines may be provided such as the use of a low frequency driver with a free-air resonance ($F_S$) preferably greater than wave-column fundamental tuning frequency ($F_{B1}$) or cut-off frequency ($F_C$) by a factor of at least 1.41 to provide suspension stiffness to control excursion below $F_C$. The most effective output may be realized with a high-pass or notch filter placed approximately ⅓ octave below $F_C$. The average cross sectional area of each wave-column may be optimally set equal to between 0.5 and 1.0 driver diaphragm area (SD). If enclosure pressures are unusually high, construction integrity should be exercised to avoid enclosure wall flexing which may cause signal loss and/or audible surface vibrations. Ribbed or braced panels, or lightweight, high-strength cylindrical enclosure forms may be used in this case. Certain signal processing techniques can be used to smooth amplitude response, extend bandwidth, or increase acoustic output capability.

Embodiments of the DWC enclosure described herein provide an advantageous level of acoustic power density for a given enclosure size and driver cubic displacement capability by way of incorporating an interactive set of controlled, odd quarter wavelength resonant power modes transitioning to regenerative, summation and mutual coupling modes to maintain smooth amplitude response at high output levels with minimized driver excursion and reduced distortion. Frequency ranges of regeneration, summation, and mutual coupling modes allow the non-resonant frequency ranges of the system to increase in level to match the small signal sensitivity levels and large signal amplitude levels of the resonant power frequencies, providing superior system efficiency without the need for damping resonant peaks. Linear free-flow wave-columns without folds may also eliminate need for damping material within the wave-columns, which further maximizes system efficiency while eliminating reflections resonances and fold turbulence. Form factors may be adapted for utilization in the consumer/domestic or commercial and professional sound applications, and the acoustic capability and form factor is particularly adaptive to large screen theater venues.

Embodiments have been described for a low frequency, high power density driver/enclosure architecture for advancing low frequency acoustic output over prior art systems. The enclosure design inherently exhibits superior passive efficiency for a given low-frequency bandwidth and enclosure volume, (approximately +6 dB over an acoustic suspension and +3 dB over a bass reflex and bandpass systems) and usefully maximizes acoustic output while minimizing driver diaphragm excursion, providing superior large signal capability for a given driver cubic volume displacement ability. By using a unique form of interactive, anti-parallel wave-columns with multiple drivers interconnecting the two wave-columns, the enclosure creates a hybrid anti-resonator/regenerative transition across the passband that equalizes the resonant and non-resonant modalities with acoustic summation and regeneration by way of acoustic cross-coupling of the multiple drivers within the wave-columns.

The advantages of the DWC enclosure system are increased system efficiency, increased large signal output over the operating range of the system, decreased diaphragm excursion over the operating range of the system, decreased distortion over the operating range of the system, low group delay/smooth phase response relative to other resonant systems, driver acoustical cross coupling for increased diaphragm control, optimum driver parameters allow higher moving mass and longer X-max (maximum linear excursion) construction of the dual drivers further increasing output capability by approximately 6 dB, mutual coupling coordinated to increase output and reduce diaphragm displacement at the most critical diaphragm displacement frequency range, and low profile form factor for under-screen mounting.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

LIST OF EMBODIMENTS

1. An audio loudspeaker comprising:

a longitudinal, semi-enclosed structure having an internal baffle creating a first wave-column having a first closed end and a first exit, and a second wave-column having a second closed end and a second exit;

a first driver mounted to a first end of the baffle and configured to project resonant acoustic energy from a first polarity side of the first driver down the first wave-column at every effective odd one-quarter wavelength frequency and directly out of the second exit of the second wave-column from a second polarity side of the first driver; and a second driver mounted to a second end of baffle and configured to project resonant acoustic energy from the second polarity side of the second driver down the first wave-column at every effective odd one-quarter wavelength frequency and directly out of the second exit of the second wave-column from the first polarity side of the second driver.

2. The loudspeaker of embodiment 1 wherein:

the first polarity side of the second driver projects, at a frequency corresponding to approximately one-half wavelength, acoustic energy down the first wave-column that is reflected off the first closed end of the first wave-column to regenerate in phase with the acoustic energy projected from the first polarity side of the first driver to exit out of the first exit; and the second polarity side of the first driver projects acoustic energy down the second wave-column that is reflected off the second closed end of the second wave-column to regenerate in phase with the acoustic energy projected from the second polarity side of the second driver to exit out of the second exit.

3. The loudspeaker of embodiment 1 or embodiment 2 wherein the first and second wave-columns are one of: equal and uniform cross-sectional size along the longitudinal axis, or flared out along the longitudinal axis by flaring each wave-column such that a cross-sectional area of the wave-column adjacent the exit is different from a cross sectional area of the respective closed end.

4. The loudspeaker of embodiment 3 wherein the flaring is one of: flared out to create positive flaring along the longitudinal axis such that a cross-sectional area adjacent the exit is greater than a cross sectional area of the respective closed end, or flared in to create negative flaring along the longitudinal axis such that a cross-sectional area adjacent the exit is smaller than a cross sectional area of the respective closed end, or differentially flared such that an amount of flaring of the first wave-column is different than an amount of flaring of the second wave-column.

5. The loudspeaker of any one of embodiments 1-4 wherein a cross-sectional shape of the structure along the longitudinal axis is one of a square, a rectangle, circle, and an oval, and wherein each of the first driver and second driver may comprise a driver array each having two or more drivers.

6. The loudspeaker of embodiment 5 wherein the structure is curved along an axis perpendicular to the longitudinal axis, and wherein the first exit and second exit project the resonant energy in substantially the same direction relative to the perpendicular axis.

7. The loudspeaker of any one of embodiments 1-6 wherein a first end of the baffle is substantially nearer the first closed end than the first exit, and a second end of the baffle is substantially nearer the second closed end than the second exit, and wherein a distance to the first end of the baffle from the first closed end is one of: the same as a distance to the second end of the baffle, and different from the distance to the second end of the baffle.

8. The loudspeaker of any one of embodiments 1-7 wherein the loudspeaker further comprises at least one of: one or more amplifier elements coupled to each of the first and second drivers to optimize a summation effect of the acoustic energy and provide greater output and extended bandwidth of the loudspeaker, or a pair of supplemental drivers mounted on respective walls of the structure in a location proximate a middle of the baffle, wherein each driver of the pair drives a respective wave-column to extend a low-frequency bandwidth of the respective wave-column, and a vented Helmholtz-tuned chamber in each wave-column formed by placing a respective driver in a position that seals a portion of the wave-column to produce air resonance effects within the chamber, and wherein each chamber is tunable to eliminate cancellation effects or provide filter effects of the wave-columns.

9. The loudspeaker of any one of embodiments 1-8 wherein at least one of the first and second wave-columns has one or more folds configured to route sound internally in the enclosure to be exited through respective exit holes located at one of an end of the enclosure or a side surface of the enclosure, wherein the exit holes are configured to be adjacent to one another in a vertical or horizontal orientation, or opposite one another relative to sides of the enclosure, and wherein an expansion rate of either the first and second wave-column may be non-uniform.

What is claimed is:

1. An audio loudspeaker comprising:

a longitudinal, semi-enclosed structure having an internal baffle creating a first wave-column having a first closed end and a first exit, and a second wave-column having a second closed end and a second exit;

a first driver mounted to a first end of the baffle and configured to project resonant acoustic energy from a first polarity side of the first driver down the first wave-column at every effective odd one-quarter wavelength frequency and directly out of the second exit of the second wave-column from a second polarity side of the first driver; and a second driver mounted to a second end of the baffle and configured to project resonant acoustic energy from a first polarity side of the second driver down the second wave-column at every effective odd one-quarter wavelength frequency and directly out of the first exit of the first wave-column from a second polarity side of the second driver.

2. The loudspeaker of claim 1, wherein:

the first driver is configured project resonant acoustic energy from the first polarity side of the first driver into the first closed end of the first wave-column past the second polarity side of the second driver and out the first exit of the first wave-column; and the second driver is configured to project resonant acoustic energy from the first polarity side of the second driver into the second closed end of the second wave-column past the second polarity side of the first driver and out the second exit of the second wave-column.

3. The loudspeaker of claim 1, wherein:

the first polarity sides of the first and second drivers are front sides of the first and second drivers, respectively, and both the drivers are provided with the same phase electrical connections; or the first polarity sides of the first and second drivers are back sides of the first and second drivers, respectively, and both the drivers are provided with the same phase electrical connections; or the first polarity side of one of the first and second drivers is a front side of that driver while the first polarity side of the other driver is a back side of that other driver, and the first and second drivers are wired out-of-phase relative to each other.

4. The loudspeaker of claim 1, wherein:

the second polarity side of the second driver projects, at a frequency corresponding to approximately one-half wavelength, acoustic energy down the first wave-column that is reflected off the first closed end of the first wave-column to regenerate in phase with the acoustic energy projected from the first polarity side of the first driver to exit out of the first exit; and the second polarity side of the first driver projects acoustic energy down the second wave-column that is reflected off the second closed end of the second wave-column to regenerate in phase with the acoustic energy projected from the first polarity side of the second driver to exit out of the second exit.

5. The loudspeaker of claim 1, wherein the first and second wave-columns are one of: equal and uniform cross-sectional size along the longitudinal axis, or flared out along the longitudinal axis by flaring each wave-column such that a cross-sectional area of the wave-column adjacent the exit is different from a cross sectional area of the respective closed end.

6. The loudspeaker of claim 5 wherein the flaring is one of: flared out to create positive flaring along the longitudinal axis such that a cross-sectional area adjacent the exit is greater than a cross sectional area of the respective closed end, or flared in to create negative flaring along the longitudinal axis such that a cross-sectional area adjacent the exit is smaller than a cross sectional area of the respective closed end, or differentially flared such that an amount of flaring of the first wave-column is different than an amount of flaring of the second wave-column.

7. The loudspeaker of claim 1, wherein a cross-sectional shape of the structure along the longitudinal axis is one of a square, a rectangle, circle, and an oval, and wherein each of the first driver and second driver may comprise a driver array each having two or more drivers.

8. The loudspeaker of claim 7 wherein the structure is curved along an axis perpendicular to the longitudinal axis, and wherein the first exit and second exit project the resonant energy in substantially the same direction relative to the perpendicular axis.

9. The loudspeaker of claim 1, wherein a first end of the baffle is substantially nearer the first closed end than the first exit, and a second end of the baffle is substantially nearer the second closed end than the second exit, and wherein a distance to the first end of the baffle from the first closed end is one of: the same as a distance to the second end of the baffle, and different from the distance to the second end of the baffle.

10. The loudspeaker of claim 1, wherein the loudspeaker further comprises at least one of: one or more amplifier elements coupled to each of the first and second drivers to optimize a summation effect of the acoustic energy and provide greater output and extended bandwidth of the loudspeaker, or a pair of supplemental drivers mounted on respective walls of the structure in a location proximate a middle of the baffle, wherein each driver of the pair drives a respective wave-column to extend a low-frequency bandwidth of the respective wave-column, and a vented Helmholtz-tuned chamber in each wave-column formed by placing a respective driver in a position that seals a portion of the wave-column to produce air resonance effects within the chamber, and wherein each chamber is tunable to eliminate cancellation effects or provide filter effects of the wave-columns.

11. The loudspeaker of claim 1, wherein at least one of the first and second wave-columns has one or more folds configured to route sound internally in the enclosure to be exited through respective exit holes located at one of an end of the enclosure or a side surface of the enclosure, wherein the exit holes are configured to be adjacent to one another in a vertical or horizontal orientation, or opposite one another relative to sides of the enclosure, and wherein an expansion rate of either the first and second wave-column may be non-uniform.

12. A method of reducing diaphragm excursion and increasing output of drivers in a loudspeaker, comprising:

transmitting resonant acoustic energy from a first polarity side of a first driver down a throat of a first wave-column past a second polarity side of a second driver and out an exit of the first wave-column;

transmitting resonant acoustic energy from a first polarity side of the second driver down a throat of a second wave-column past a second polarity side of the first driver and out an exit of the second wave-column; and configuring the first and second wave-columns so that the first and second drivers are cross-coupled such that at an effective one-quarter wavelength frequency, a maximum cone excursion of each driver is minimized and acoustic output is maximized relative to defined reference values.

13. The method of claim 12, wherein:

the first polarity sides of the first and second drivers are front sides of the first and second drivers, respectively, and both the drivers are provided with the same phase electrical connections; or the first polarity sides of the first and second drivers are back sides of the first and second drivers, respectively, and both the drivers are provided with the same phase electrical connections; or the first polarity side of one of the first and second drivers is a front side of that driver while the first polarity side of the other driver is a back side of that other driver, and the first and second drivers are wired out-of-phase relative to each other.

14. The method of claim 12 further comprising configuring the first and second wave-columns such that:

at approximately a one-half wavelength frequency, a first polarity wave of the first driver is cross-coupled to, and in-phase with, a second polarity wave of the second driver so that the acoustic output is increased, reinforced, and smoothed at the approximately one-half wavelength frequency; and at frequencies below a one-half wavelength frequency, corresponding to the spacing between the first and second exits, acoustic output at the first and second exits achieve an acoustic mutual coupling effect that boosts acoustic output.

15. The method of claim 12 wherein the first and second wave-columns are one of: equal and uniform cross-sectional size along a longitudinal axis between an exit and throat of the wave-column, or flared out along the longitudinal axis by flaring each wave-column such that a cross-sectional area of the wave-column exit is different from a cross sectional area of a corresponding wave-column throat.

16. The method of claim 15 wherein the flaring is one of: flared out to create positive flaring along the longitudinal axis such that a cross-sectional area of the exit is greater than a cross sectional area of the corresponding throat, or flared in to create negative flaring along the longitudinal axis such that a cross-sectional area of the exit is smaller than a cross sectional area of the corresponding throat, or differentially flared such that an amount of flaring of the first wave-column is different than an amount of flaring of the second wave-column.

17. The method of claim 12 wherein a cross-sectional shape of the structure along the longitudinal axis is one of a square, a rectangle, circle, and an oval.

18. The method of claim 17 wherein the structure is curved along an axis perpendicular to the longitudinal axis, and wherein the first exit and second exit project the acoustic energy in substantially the same direction relative to the perpendicular axis.

* * * * *